US011754366B2

(12) United States Patent
Hamilton

(10) Patent No.: US 11,754,366 B2
(45) Date of Patent: Sep. 12, 2023

(54) MUZZLE LOADER UPPER RECEIVER FOR AR PATTERN RIFLE

(71) Applicant: UINTAH PRECISION LLC, Duchesne, UT (US)

(72) Inventor: Richard Hamilton, Duchesne, UT (US)

(73) Assignee: UINTAH PRECISION LLC, Duchesne, UT (US)

( * ) Notice: Subject to any disclaimer, the term of this patent is extended or adjusted under 35 U.S.C. 154(b) by 0 days.

(21) Appl. No.: 17/578,216

(22) Filed: Jan. 18, 2022

(65) Prior Publication Data

US 2022/0236032 A1 Jul. 28, 2022

Related U.S. Application Data

(60) Provisional application No. 63/140,510, filed on Jan. 22, 2021.

(51) Int. Cl.

| | |
|---|---|
| ***F41C 9/08*** | (2006.01) |
| ***F41A 3/74*** | (2006.01) |
| ***F41A 3/66*** | (2006.01) |

(52) U.S. Cl.

CPC ..... *F41C 9/08* (2013.01); *F41A 3/66* (2013.01); *F41A 3/74* (2013.01); *F41C 9/085* (2013.01)

(58) Field of Classification Search

CPC ..... F41C 9/08

See application file for complete search history.

(56) References Cited

U.S. PATENT DOCUMENTS

| | | | | |
|---|---|---|---|---|
| 4,515,064 | A | 5/1985 | Hohrein | |
| 8,079,167 | B1 * | 12/2011 | Overstreet | F41C 9/08 89/1.3 |
| 9,038,303 | B1 | 5/2015 | Olson | |
| 9,234,713 | B1 | 1/2016 | Olson | |
| 9,279,628 | B1 | 3/2016 | Pollack | |
| 9,739,553 | B1 * | 8/2017 | Gibbons, III | F41C 9/08 |
| 9,885,528 | B2 | 2/2018 | Mather | |
| 10,458,731 | B2 | 10/2019 | Mather | |
| 10,627,177 | B2 | 4/2020 | Hamilton | |
| 2010/0281733 | A1 | 11/2010 | Constant | |
| 2011/0061523 | A1 | 3/2011 | Webb | |
| 2013/0269510 | A1 | 10/2013 | Sullivan | |
| 2014/0075806 | A1 | 3/2014 | Blank | |

(Continued)

FOREIGN PATENT DOCUMENTS

WO 2018058174 4/2018

*Primary Examiner* — Reginald S Tillman, Jr.

(74) *Attorney, Agent, or Firm* — MASCHOFF BRENNAN

(57) ABSTRACT

A muzzle loader AR upper receiver can include a muzzle loader AR pattern upper receiver configured to be coupled with an AR pattern lower receiver. The muzzle loader AR pattern upper receiver includes a body with a barrel opening. A muzzle loader barrel is coupled to the barrel opening of the muzzle loader AR pattern upper receiver. A muzzle loader AR rifle can include the muzzle loader AR pattern upper receiver and the AR pattern lower receiver coupled to the muzzle loader AR pattern upper receiver. A method of forming a muzzle loader rifle can include: providing a muzzle loader AR upper receiver; and coupling the muzzle loader AR upper receiver to an AR pattern lower receiver. A muzzle loader kit can include the muzzle loader AR pattern upper receiver and any other component, such as a ramrod, barrel, or AR pattern lower receiver.

32 Claims, 23 Drawing Sheets

(56) References Cited

U.S. PATENT DOCUMENTS

| | | | |
|---|---|---|---|
| 2014/0075807 | A1 | 3/2014 | Lewis |
| 2015/0198394 | A1 | 7/2015 | Hochstrate et al. |
| 2015/0233656 | A1 | 8/2015 | Karagias |
| 2016/0238334 | A1 | 8/2016 | Pflaumer et al. |
| 2016/0252314 | A1 | 9/2016 | Mather |
| 2016/0348990 | A1 | 12/2016 | Steil |
| 2017/0198999 | A1 | 7/2017 | Goddard et al. |
| 2018/0045476 | A1 | 2/2018 | Hamilton |
| 2018/0112939 | A1 | 4/2018 | Wheatley |

* cited by examiner

MUZZLE LOADER UPPER RECEIVER FOR AR PATTERN RIFLE

CROSS-REFERENCE

This patent application claims priority to U.S. Provisional Application No. 63/140,510 filed Jan. 22, 2021, which provisional application is incorporated herein by specific reference in their entirety.

BACKGROUND

Field

The present disclosure relates to a muzzle loader AP pattern upper receiver that can be used to convert an AR rifle with an AR pattern lower receiver into a muzzle loader rifle. More particularly, the present disclosure relates to the components of the muzzle loader AR pattern receiver, which includes a muzzle loader barrel with a blast cap receiver and a bolt assembly coupled to the barrel that has a bolt configured for use with the muzzle loader barrel.

Description of Related Art

Often, rifle sportsmen enjoy shooting guns of different types and different calibers. However, one gun is often of a single type and of a single caliber. As such, the rifle sportsman has to obtain multiple guns in order to have different types and/or different calibers. While it may be favorable to have different types of guns, the rifle sportsman is forced into buying multiple guns.

Therefore, it would be advantageous to be able to have a gun that converts from a first type to a second type.

SUMMARY

In some embodiments, a muzzle loader AR rifle can include: an AR patterned muzzle loader upper receiver; a muzzle loader barrel coupled to the upper receiver; a bolt in the muzzle loader upper receiver; and an AR pattern lower receiver coupled to the muzzle loader upper receiver, wherein the lower receiver includes a trigger.

In some embodiments, a method of forming a muzzle loader AR rifle can include: providing an AR patterned muzzle loader upper receiver assembly of one of the embodiments; providing a standard AR patterned lower receiver assembly having a pivot pin and takedown pin; inserting the pivot pin into the pivot pin receiver hole; pivoting the muzzle loader upper receiver assembly at the pivot pin until the takedown pin is aligned with the takedown pin receiver hole; and inserting the takedown pin into the takedown pin receiver hole.

In some embodiments, a bolt can be configured for being included in a muzzle loader upper receiver, wherein the muzzle loader upper receiver is configured to be coupled to a AR pattern lower receiver assembly. The bolt can include a longitudinal axis and a longitudinal sequence comprising: a bolt tip; a cylindrical region; and a bolt end having a firing pin recess. In some aspects, the cylindrical region includes a cylindrical surface without any recesses. In some aspects, the cylindrical region is devoid of recesses or elevations between the front end and opener portion. In some aspects, an annular lip at the bolt tip includes an extractor in an extractor slot formed in the annular lip. In some aspects, a firing pin recess is included in the bolt and optionally a firing pin therein.

In some embodiments, a bolt can be configured for being included in an AR pattern muzzle loader upper receiver of an AR pattern muzzle loader upper receiver assembly. The muzzle loader upper receiver assembly can be configured to be coupled to a standard AR pattern lower receiver assembly. The bolt includes a unitary body as illustrated and described herein.

In some embodiments, an AR patterned muzzle loader upper receiver can be configured to be coupled with a standard AR patterned lower receiver. The AR patterned muzzle loader upper receiver can include a unitary receiver body having a receiver lumen. The unitary receiver body can include: a top; a proximal end having a bolt opening with the bolt of one of the embodiments located therein; and a distal end having a barrel opening. In some embodiments, a bottom of the receiver body can include: a magazine slot open to and longitudinally aligned with a hammer slot, the hammer slot being narrower than the magazine slot. However, some muzzle loader configurations can omit the magazine slot as there is magazine used in a muzzle loader. On the other hand, use of the AR patterned upper receiver described herein can be used for the muzzle loader configuration or the bolt action configuration of the incorporated references.

In some embodiments, a takedown pin receiver hole is at a proximal end, the takedown pin receiver hole being orthogonal with the magazine slot and hammer slot; and a pivot pin receiver hole at a distal end, the pivot pin receiver hole being orthogonal with the magazine slot and hammer slot, the pivot pin receiver hole being parallel with the takedown pin receiver hole.

In some embodiments, the receiver body can include a first side having: a bolt handle slot extending from the bolt opening; a bolt rest slot extending from the bolt handle slot. In some aspects, the receiver body can also include an ejection port between the bolt handle slot and distal end, which can allow for the same receiver body to be used for a bolt action receiver body and the muzzle loader receiving body (see the cross-referenced applications). The receiver body can also include a second side.

In some embodiments, an AR patterned muzzle loader upper receiver assembly can include: an AR patterned muzzle loader upper receiver configured to be coupled with a standard AR patterned lower receiver, wherein the muzzle loader upper receiver comprises a unitary receiver body having a receiver lumen. In some aspects, the unitary receiver body can have: a top; a proximal end having a bolt opening; a distal end having a barrel opening; a bottom, a first side and a second side. In some embodiments, the bottom can include: a magazine slot open to and longitudinally aligned with a hammer slot, wherein the hammer slot is narrower than the magazine slot. In some aspects, the magazine slot is omitted in a muzzle loader specific configuration of the unitary receiver body. The first side can have: a bolt handle slot extending from the bolt opening and exposing a portion of the receiver lumen; a bolt rest slot extending from the bolt handle slot; and an ejection port between the bolt handle slot and distal end. Additionally, the bolt of one of the embodiments can be slidably located in the receiver lumen.

In some embodiments, an AR patterned muzzle loader rifle can include: an AR patterned upper receiver; a muzzle loader barrel coupled to the upper receiver, wherein the muzzle loader barrel is configured as described herein; the bolt of one of the embodiments can be slidably located in the upper receiver; and an AR patterned lower receiver is coupled to the upper receiver, wherein the lower receiver includes a trigger and a magazine recess.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE FIGURES

The foregoing and following information as well as other features of this disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings.

Figure 1:
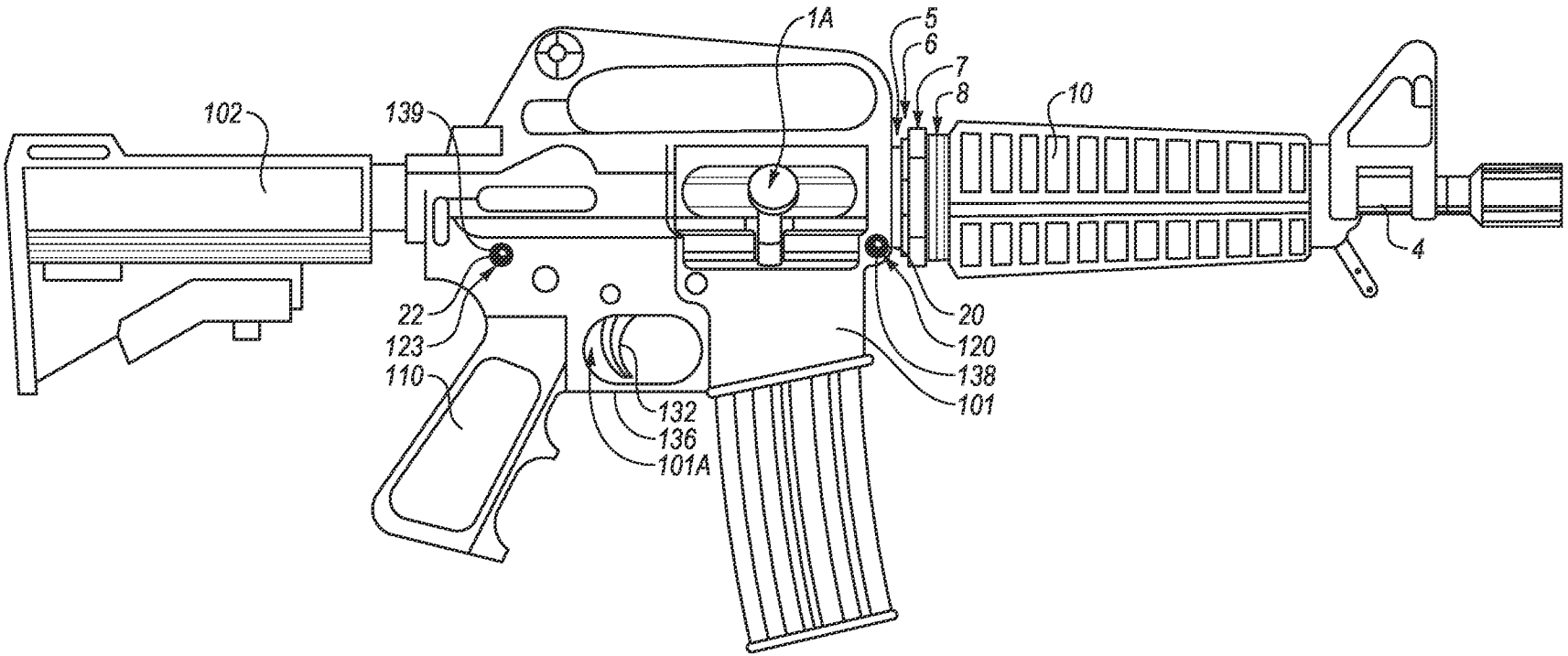
FIG. 1 (Prior Art)
FIG. 1 illustrates a side view of an AR rifle (Prior Art).

The components of the figures are arranged in accordance with at least one of the embodiments described herein, and which arrangement may be modified in accordance with the disclosure provided herein by one of ordinary skill in the art.

DETAILED DESCRIPTION

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the figures, can be arranged, substituted, combined, separated, and designed in a wide variety of different configurations, all of which are explicitly contemplated herein.

Generally, the present invention relates to an AR rifle, such as an AR-10 and/or AR-15 or other configured and modifiable rifle as described herein. Particularly, the invention relates to a DPMS LR-308 pattern (e.g., AR pattern) for an upper assembly and lower assembly of an AR pattern rifle; however, it should be recognized that any appropriately configured rifle (e.g., Armalite AR-10 pattern) that can have the upper assembly separable from the lower assembly in the manner described herein may be combined with the muzzle loader upper assembly of the present invention. Now, with the present invention that includes a muzzle loader upper assembly that can be fit onto and coupled with a lower assembly (e.g., unmodified lower assembly, such as a DPMS LR-308 pattern, or Armalite AR-10 pattern), an AR pattern rifle may be converted to a muzzle loader rifle by merely replacing any AR pattern upper assembly or standard semi-automatic AR pattern upper assembly with the AR pattern muzzle loader upper assembly as described herein. As such, reference herein to AR rifles applies equally to the AR-10 and/or AR-15 or other similar rifles. One of skill in the art can use the teachings related to the AR-10 muzzle loader upper assembly provided herein in order to prepare an AR-15 muzzle loader upper assembly or any other AR rifle having the same type of coupling and pattern. While the application teaches the DPMS LR-308 pattern, the teachings are also for an Armalite AR-10 pattern.

As used herein, the "AR" is intended to mean a rifle of the type of AR pattern platform rifles (e.g., ArmaLite rifle pattern) that are commonly known, which are "assault rifle" type and may be "automatic rifle" type or "semi-automatic rifle" type. Otherwise, the AR is as defined herein can include the coupling pattern with the pin hole placement and alignment, along with the magazine, and/or hammer alignments. Also, it should be understood that the AR may be of any manufacturer that makes an AR rifle as known and understood by one of ordinary skill in the art. It is well known that an AR rifle is a specific platform and type of rifle.

In one aspect, the subject matter described herein is related to a DPMS LR-308 pattern muzzle loader (ML) upper assembly, DPMS LR-308 pattern bolt action (BA) upper assembly DPMS LR-308 pattern semi-automatic (SA) upper assembly, DPMS LR-308 lower assembly, and DPMS AR-10 ML or DPMS AR-10 SA. The subject matter may also relate to AR-15s, SA upper assemblies thereof, bolt action (BA) upper assemblies thereof (See incorporated references for AR bolt action), and lower assemblies thereof, which may also be DPMS LR-308 patterned. Also, it may be an Armalite AR-10 pattern.

By way of example and background, a standard semi-automatic AR pattern rifle is shown in FIG. 1. In some instances, features of the standard semi-automatic AR pattern rifle can be included in the AR pattern muzzle loader upper assembly, such as the barrel, barrel nut, and other aspects of mounting the barrel to the upper assembly. Also, the firing pin of a standard semi-automatic upper assembly may be utilized in the muzzle loader upper assembly. The present invention provides a muzzle loader upper assembly that mounts to a standard AR pattern rifle lower assembly as described herein. In fact, the muzzle loader upper assembly is configured to be self-contained and attachable to the lower assembly by using the takedown pin (e.g., rear pin) and pivot pin (e.g., front pin). For example, removing the takedown pin and pivot pin from a standard semi-automatic AR rifle allows the standard semi-automatic upper assembly to be removed from the standard lower assembly, and then the muzzle loader upper assembly can be mounted onto the standard lower assembly with the takedown pin and pivot pin replaced in order to arrive at the fully functional muzzle loader AR rifle.

FIG. 1 shows an assembled AR-10. FIG. 1 shows the semi-automatic upper assembly 1A mounted to the standard lower assembly 101A via the takedown pin 123 and pivot pin 120 being received through the proper holes in the upper assembly 1A and lower assembly 101A, such as described herein. It is noted that the takedown pin 123 and pivot pin 120 can be either of the pins labeled with 120 and 123, which can be switched to which one is the takedown and which one is the pivot.

A standard automatic or semi-automatic AR-10 upper assembly 1A often includes an upper receiver, charging handle assembly, bolt carrier assembly, barrel tube, slip ring retaining ring, slip ring spring assembly, barrel nut, slip ring, gas tube, handguard (barrel protector), handguard cap, picatinny gas block, picatinny housing clamp screw, gas tube pin, spiral pin, front sling swivel, crush washer, and flash suppressor. An upper pivot pin receiver hole 20 (e.g., for receiving the pivot pin 120) and an upper takedown pin receiver hole 22 (e.g., for receiving the takedown pin 123) are shown to receive pins (e.g., pivot pin 120 and takedown pin 123) from the lower assembly 101A in order to form the full AR-10. Due to the pivot pin 120 and takedown pin 123 being installed in the upper pivot pin receiver hole 20 and upper takedown pin receiver hole 22, respectively, the upper pivot pin receiver hole 20 and upper takedown pin receiver hole 22 are not clearly seen; however, they are shown in other figures provided herein. It should be noted that the elements 20 and 22 may be switched.

It should be noted that the barrel tube 4, slip ring retaining ring 5, slip ring spring assembly 6, barrel nut 7, and slip ring 8, can, in some embodiments, be used to mount the barrel to the inventive muzzle loader upper assembly as described herein; however, some embodiments may omit these components. The hand guard 10 may also be used with the muzzle loader upper assembly; however, a modified hand guard with a ramrod slot (e.g., holding a muzzle loader ramrod shown in FIG. 2D) may be preferred. In other embodiments, an AR free float fore end can be included in the inventive muzzle loader upper assembly as described herein.

In some embodiments, a fore end having a gas block is excluded from the present invention.

An assembled muzzle loader AR having the muzzle loader upper assembly mounted to a lower assembly 101A may be provided in an embodiment. The lower assembly 101A can include the lower receiver 101, buttstock assembly 102, receiver extension tube, operating spring 104 (FIG. 3B), buffer 105, buttstock spacer, buttstock screw, buffer detent, pistol grip 110, pistol grip screw, pistol grip washer, bolt stop, bolt stop pin, bolt stop plunger, bolt stop spring, magazine catch, magazine catch button, magazine catch spring, pivot pin 120, detent pin, detent spring, takedown pin 123, safety selector, safety spring, safety detent, trigger pin, two stage tactical hammer, D-ring, hammer torsion spring, trigger spring, two stage trigger 132, coiled spring pin, two stage disconnector, disconnector spring, trigger guard assembly 136, and trigger guard pin, as known. Pivot pin receiver hole 138 is shown to receive the pivot pin 120 (e.g., difficult to see due to the pivot pin 120 being therein) and takedown pin receiver hole 139 is shown to receive the takedown pin 123 (e.g., difficult to see due to the takedown pin 123 being therein). The entirety of the lower receiver 101 and/or lower assembly 101A may be used for the muzzle loader AR rifle described herein, where the entirety of the lower receiver assembly 101A may be mounted to the muzzle loader upper receiver assembly.

To mount the upper assembly 1A with the lower assembly 101A, the upper pivot pin receiver hole 20 is aligned with the lower pivot pin receiver hole 138 with the pivot pin 120 being received therethrough, and the upper takedown pin receiver hole 22 is aligned with the lower takedown pin receiver hole 139 with the takedown pin 123 received therethrough, in any order and vice versa. Pulling out the takedown pin 123 and pivot pin 120 allows disassembly, and replacement of the takedown pin 123 and pivot pin 120 allows assembly, which can be done with either pin in any order.

The AR-10 can include a bolt carrier assembly having the firing pin retaining pin, firing pin, firing pin spring, cam pin, bold carrier, key screws, bold carrier key, and bolt assembly as separate parts, as known in an AR pattern rifle. Here, the firing pin, and firing pin spring can be used with the bolt of the muzzle loader upper assembly.

The AR-10 can include a bolt assembly having the gas ring, bolt, extractor spring insert, extractor spring, o-ring, extractor, extractor pin, ejector pin, ejector spring, and ejector. Here, the extractor spring insert, extractor spring, and extractor can be used in the muzzle loader bolt assembly described herein. Therefore, a standard AR rifle with a standard AR lower receiver we well described herein and generally known.

Figure 2A:
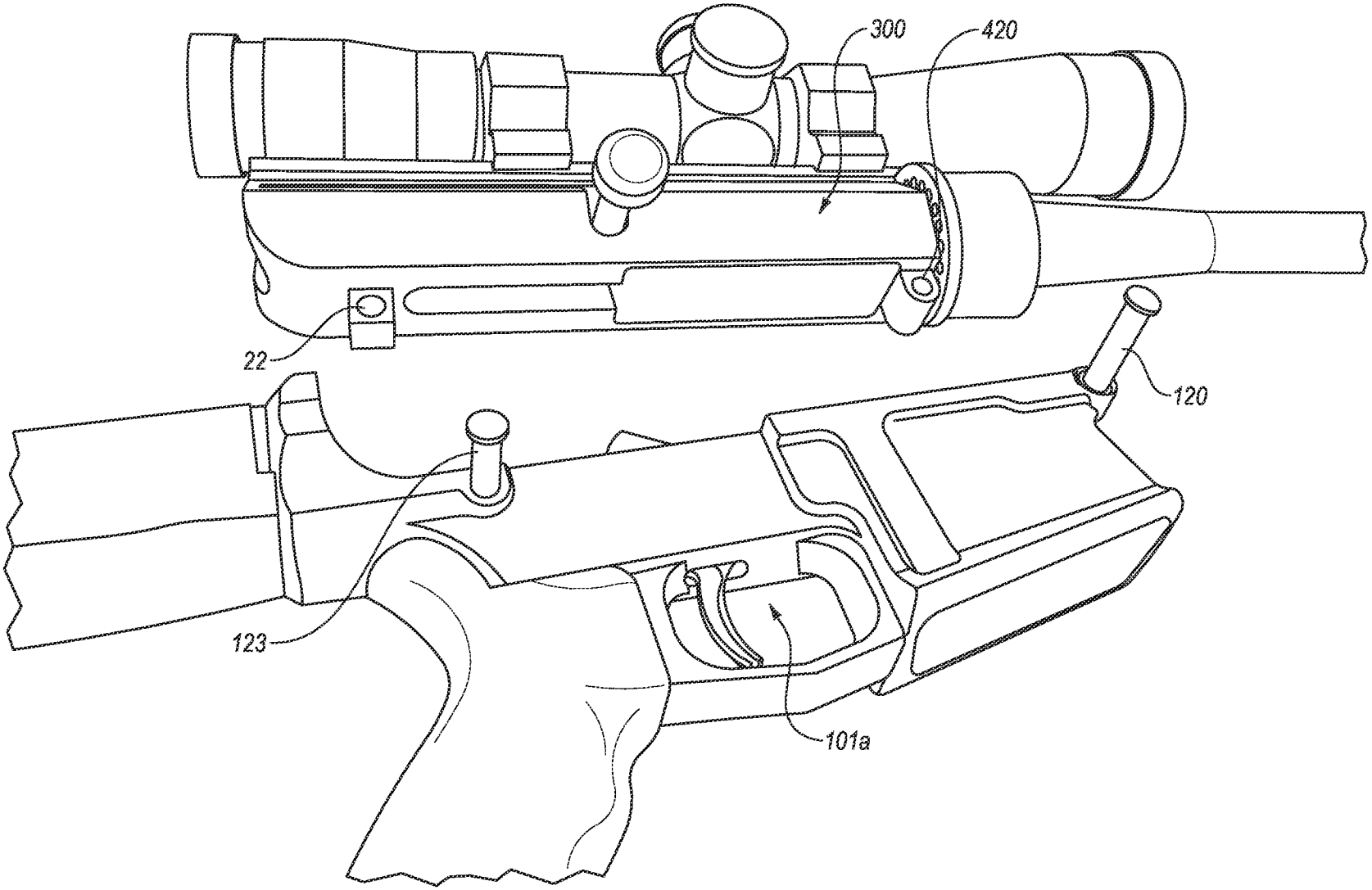
FIG. 2A illustrates a muzzle loader upper receiver assembly separate from a standard AR pattern lower receiver assembly.
Figure 2B:
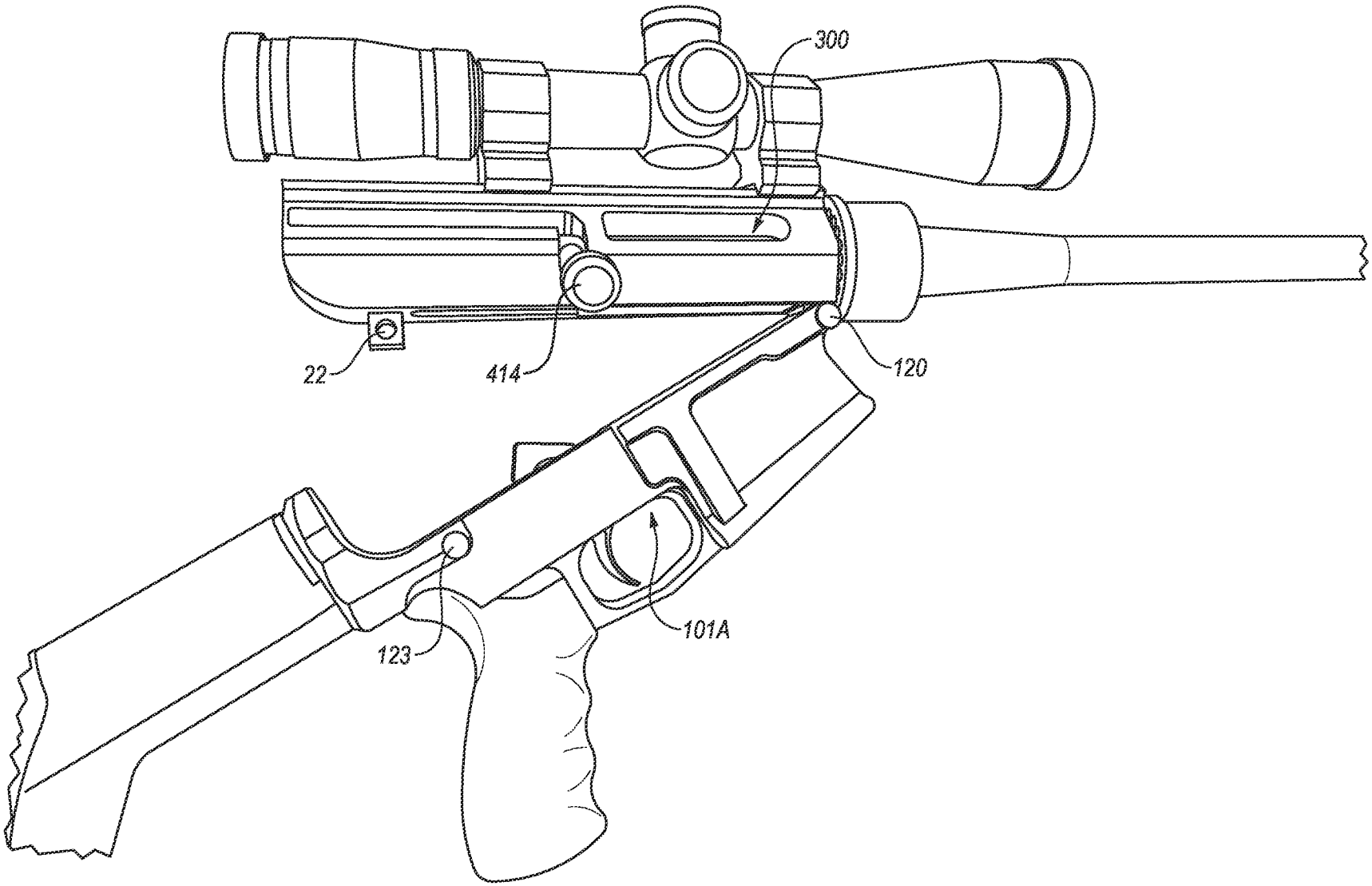
FIG. 2B illustrates a muzzle loader upper receiver assembly connected via a pivot pin to a standard AR pattern lower receiver assembly.
Figure 2C:
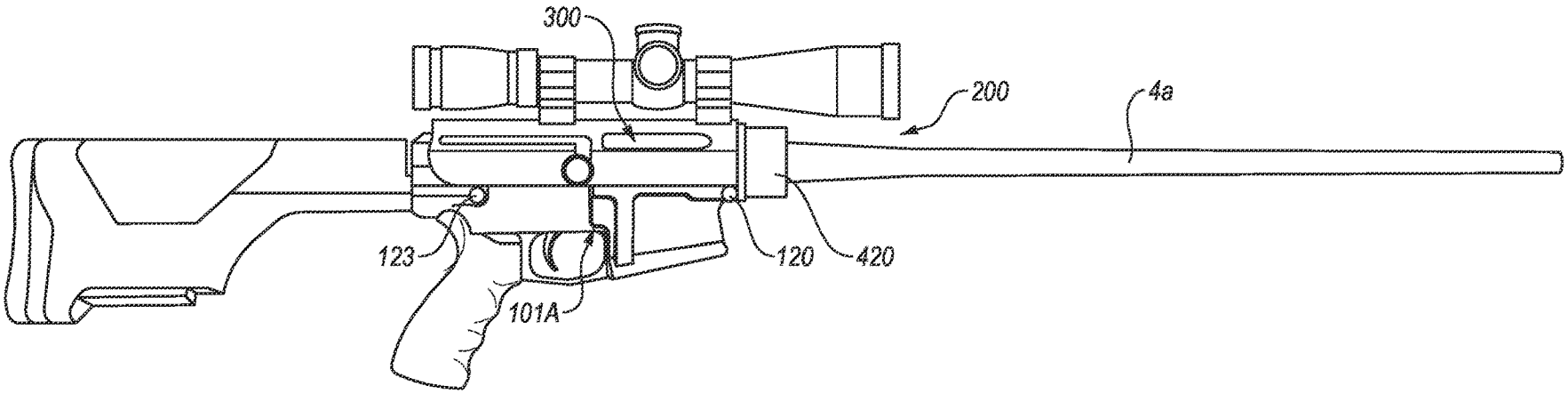
FIG. 2C illustrates a muzzle loader upper receiver assembly connected via a pivot pin and takedown pin to a standard AR pattern lower receiver assembly.

FIGS. 2A-2C shows an AR-10 muzzle loader (AR-10 ML) upper assembly 300 separate from the lower assembly 101A and then the coupling of the upper assembly 300 to the lower assembly 101A in order to form the muzzle loader AR rifle 200 in FIG. 2C. FIG. 2C shows the lower assembly 101A with the pivot pin 120 and takedown pin 123 in the receiver holes to fasten the muzzle loader (ML) upper assembly 300 to the lower assembly 101A, which is the assembled muzzle loader AR rifle 200.

FIG. 2A shows the upper assembly 300 separate from the lower assembly 101A. It is noted that this lower assembly 101A is the standard AR pattern lower assembly for the semi-automatic AR rifle. FIG. 2B shows the takedown pin 123 being removed from the upper takedown pin receiver hole 22 so that the back of the ML upper assembly 300 can pivot on the pivot pin 120 in the upper pivot pin receiver hole 20. It is noted that the upper takedown pin receiver hole 22 is in a takedown receiver body, and the upper pivot pin receiver hole 20 is in a takedown pin receiver body. As shown, the takedown pin 123 and pivot pin 120 do not need to be pulled all the way out of the takedown pin receiver hole 139 and pivot pin receiver hole 138, but only from the upper takedown pin receiver hole 22 and upper pivot pin receiver hole 20. It is noted that either pin can be pulled out first for removal or inserted for assembly.

Performing the steps from FIG. 2C to 2A disassembles the AR-10 ML, and performing the steps from FIG. 2A to 2C assembles the AR-10 ML; however, either pin can be pulled first or assembled first. Also, it can be seen that the takedown pin receiver hole 139 is actually two different holes, one on each side of the lower assembly 101A, and thereby the takedown pin 123 only needs to be withdrawn from one and from the upper takedown pin receiver hole 22. Also, it can be seen that the pivot pin receiver hole 138 is actually two different holes, one on each side of the lower assembly 101A, and thereby the pivot pin 120 only needs to be withdrawn from one and from the upper pivot pin receiver hole 20.

Figure 2D:
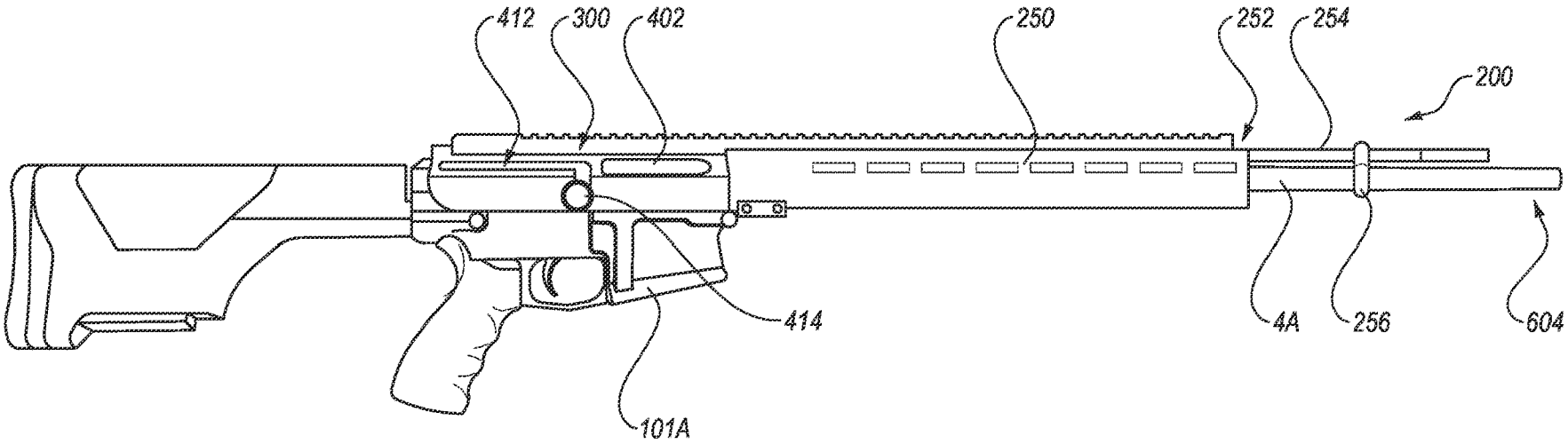
FIG. 2D illustrates a muzzle loader upper receiver with the barrel protector and the ramrod, where the muzzle loader upper receiver is connected to the standard AR pattern lower receiver to form the muzzle loader AR pattern rifle.

FIG. 2D show an embodiment of the muzzle loader AR rifle 200 ML with the ML upper assembly 300 coupled to the AR lower assembly 101A. The barrel 4*a* is covered with a barrel protector 250, which includes apertures and a picatinny rail. The barrel protector 250 can also include a ramrod slot 252 that is adapted to receive a ramrod 254 therein. A support member 256 can also be used to hold the ramrod closer to the muzzle end 604. The 414 bolt handle and handle slot 412 of the receiver 402 of the ML upper assembly 300 are clearly shown.

Figure 2E:
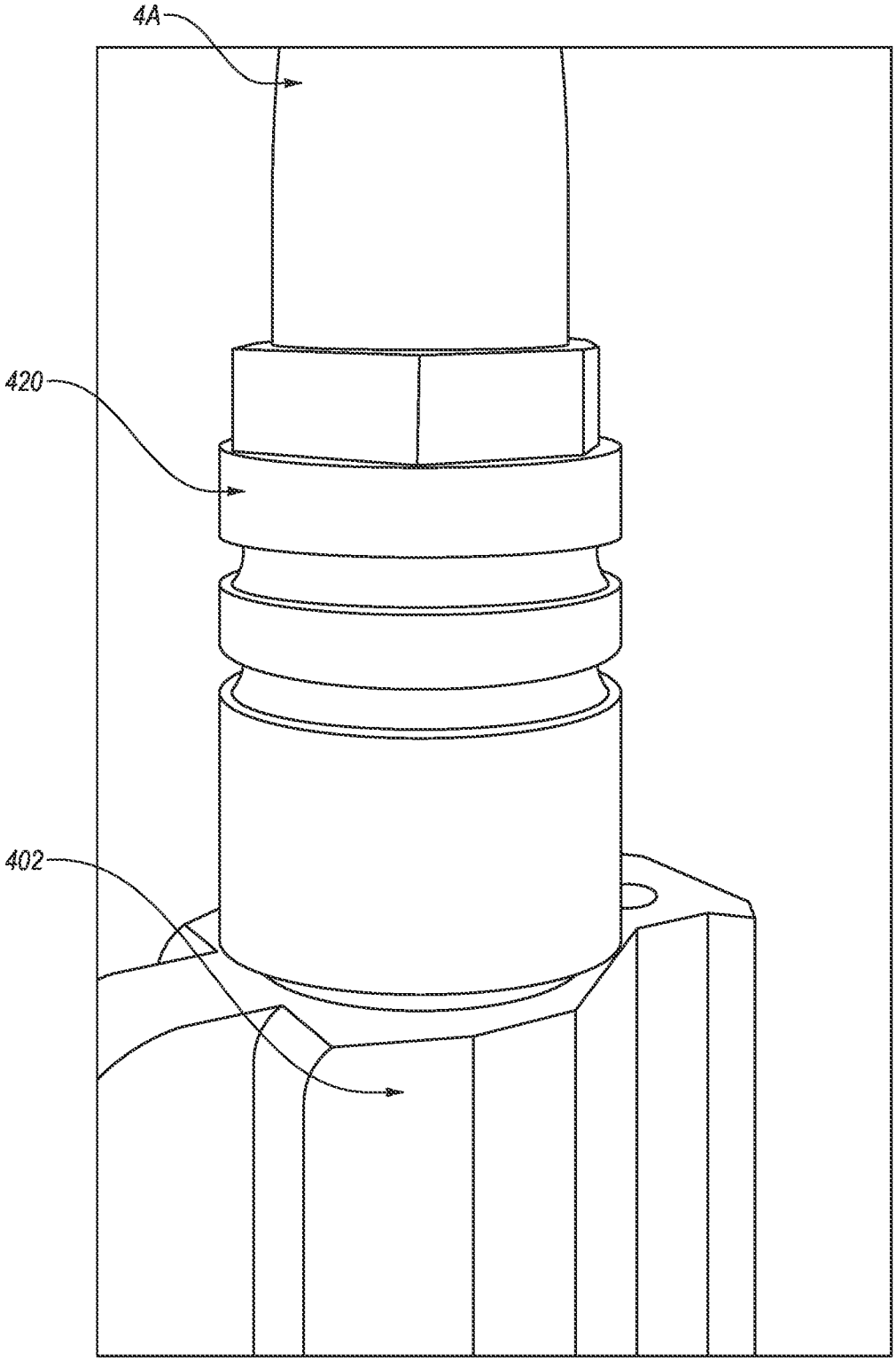
FIG. 2E illustrates the muzzle loader barrel coupled to the muzzle loader receiver via a barrel coupling nut.

FIG. 2E shows the barrel coupling nut 420 holding the barrel 4*a* to the receiver 402. The top right image shows the barrel 4*a* without the barrel coupling nut and showing the internal threading.

Figure 2F:
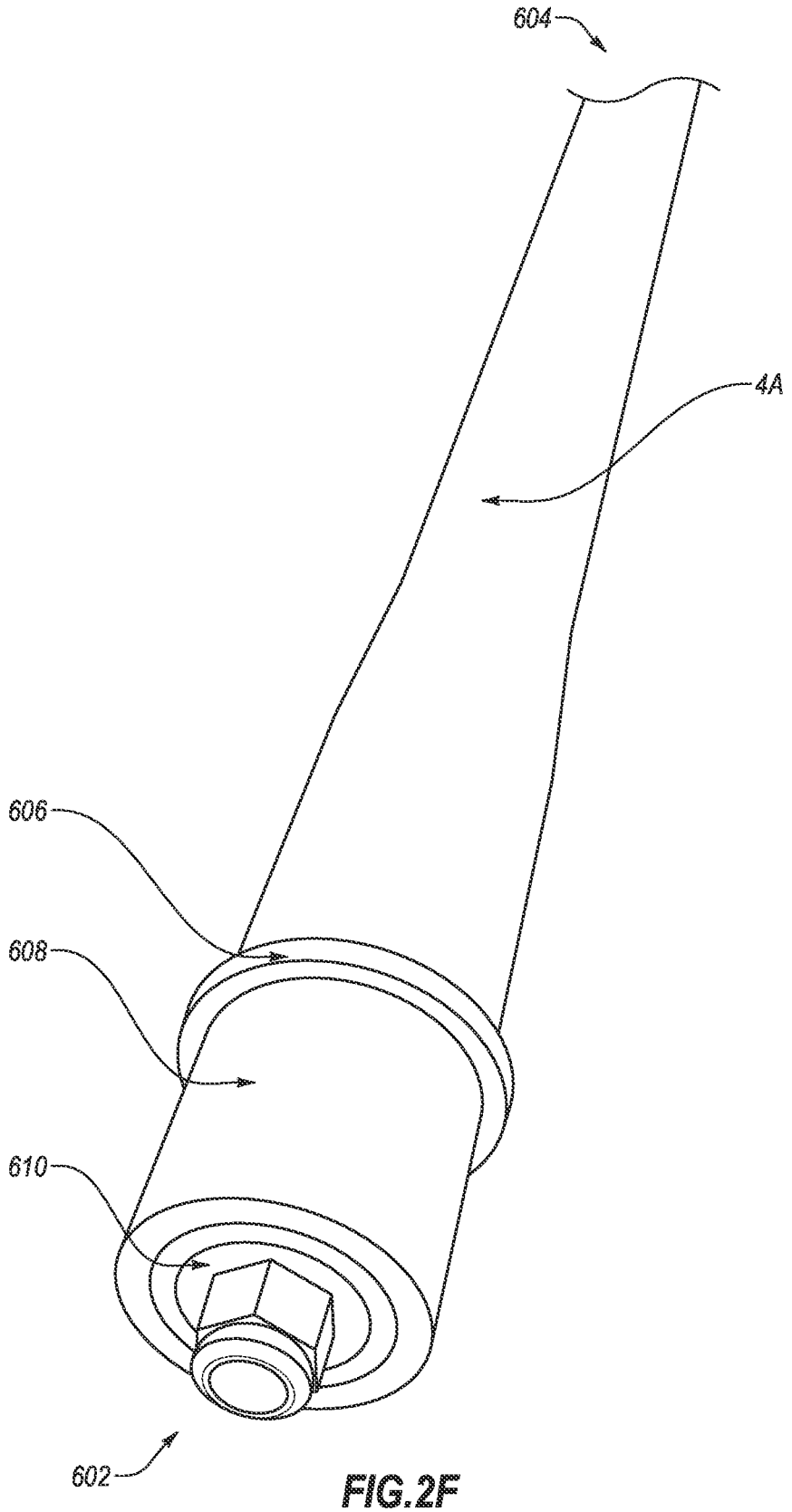
FIGS. 2F-2G illustrate the muzzle barrel having the breach plug.
Figure 2G:
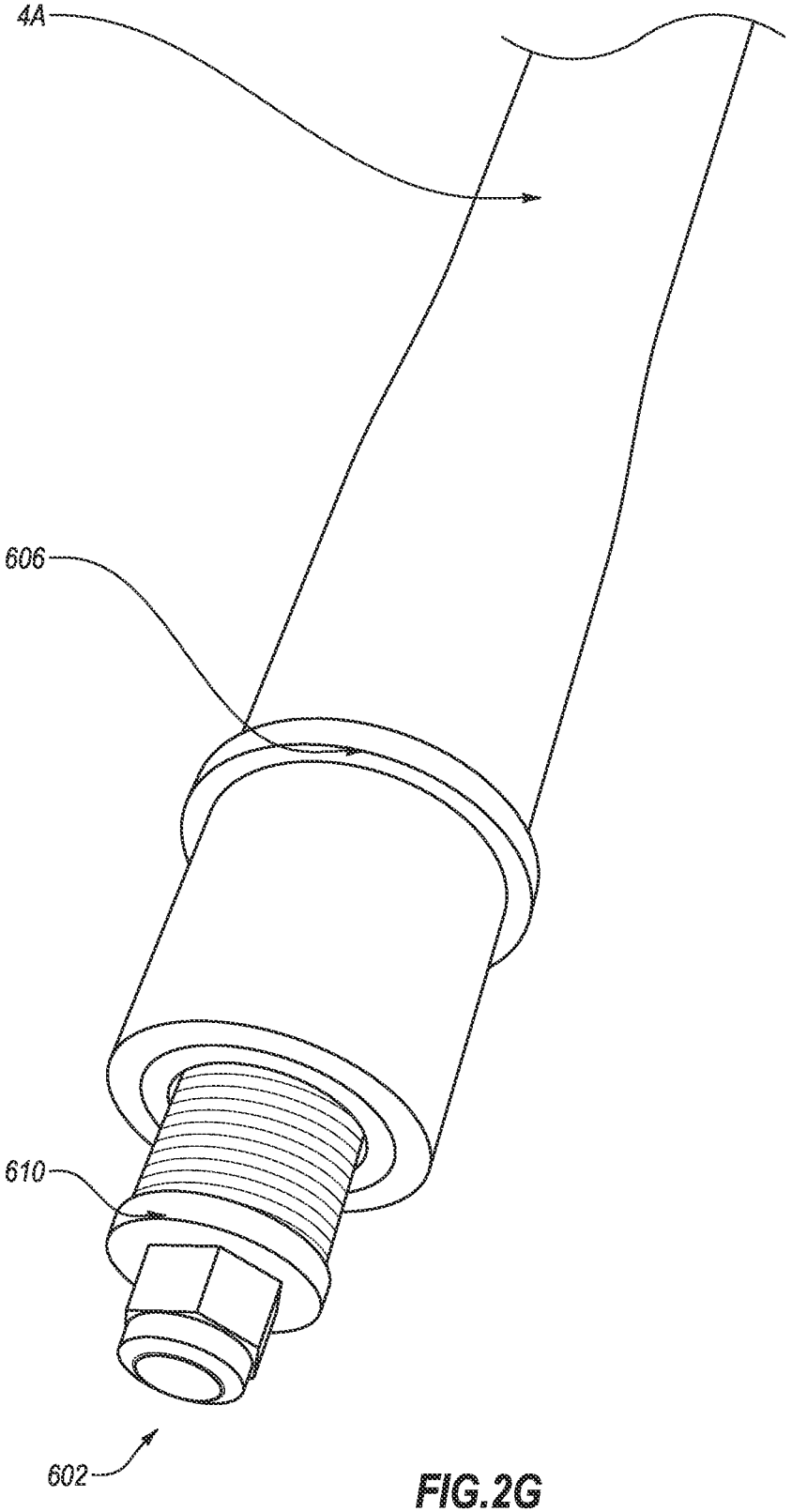
Figure 2H:
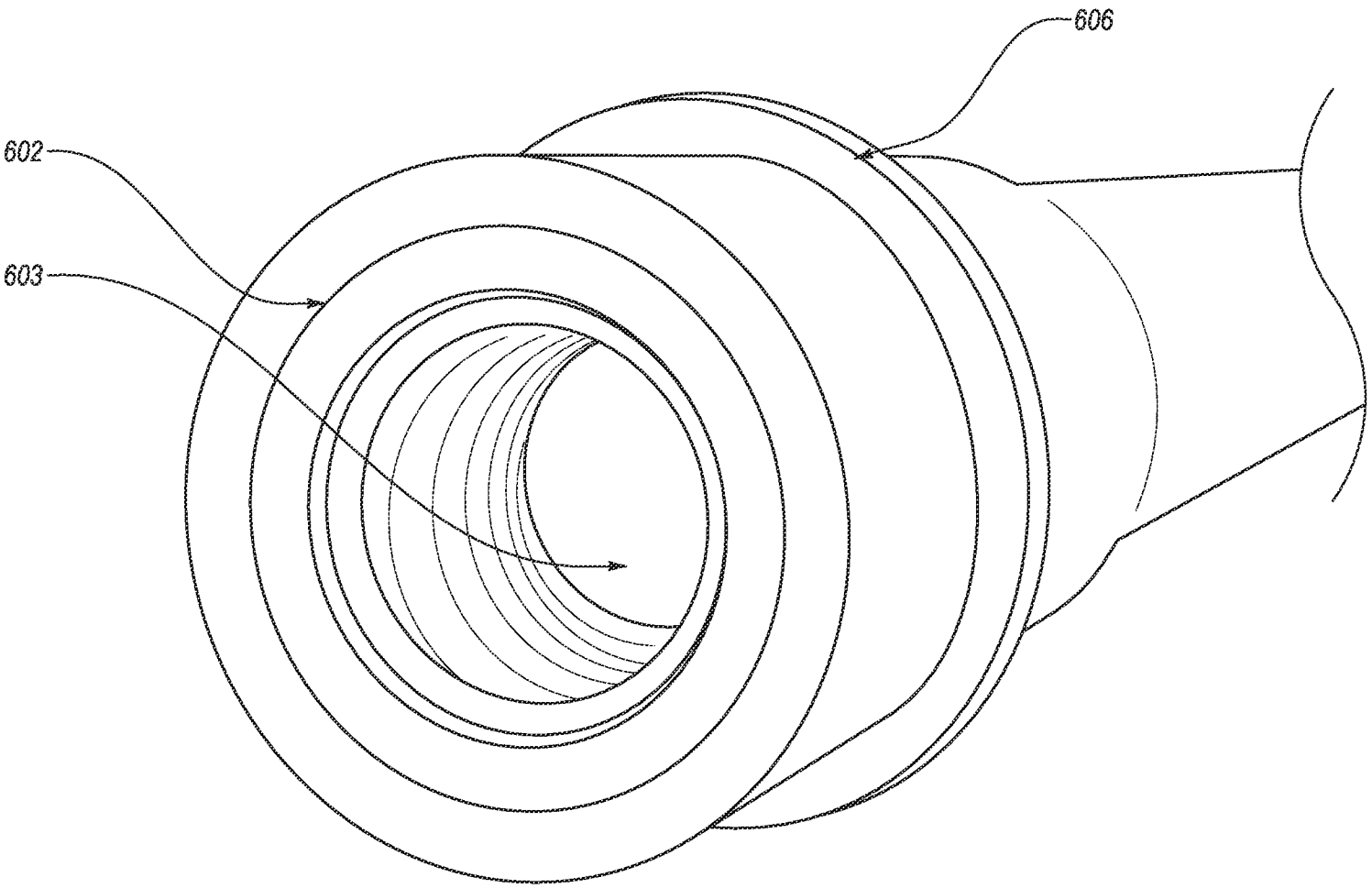
FIG. 2H illustrates the muzzle barrel without the breach plug.

FIGS. 2F-2H show the barrel 4*b* with the barrel coupling nut 420 removed. The barrel 4*b* has been machined to function similarly to a barrel extension nut, but no barrel extension nut is used. Instead, the barrel coupling nut 420 slides over the barrel 4*b* at the back end 602 opposite of the muzzle end 604. The barrel 4*a* includes an annular ridge 606 a distance from the back end 602 as shown, where a cylindrical portion 608 extends from the annular ridge 606 to the back end 602. Here, the annular ridge 606 is machined into the barrel 4*a*, which functions as the barrel extension nut. The back end 602 of the barrel 4*a* is threaded and a breach plug 610 is threadedly inserted therein. The breach plug 610 is threaded as shown, which matches the threading of the back end opening 603 of the back end 602.

FIG. 2G shows the breach plug 610 being withdrawn from the back end opening 603 of the back end 602.

FIG. 2H shows the back end opening 603 being empty.

Figure 2I:
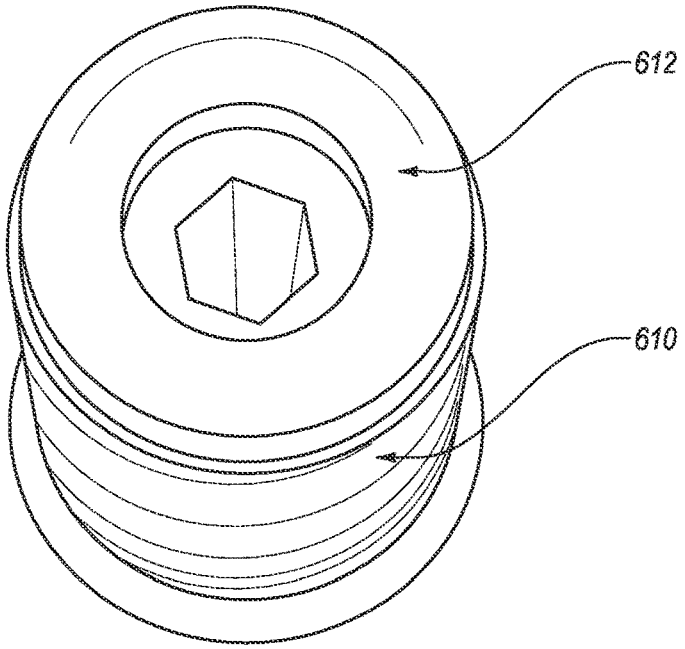
FIG. 2I illustrates the barrel side of the breach plug.
Figure 2J:
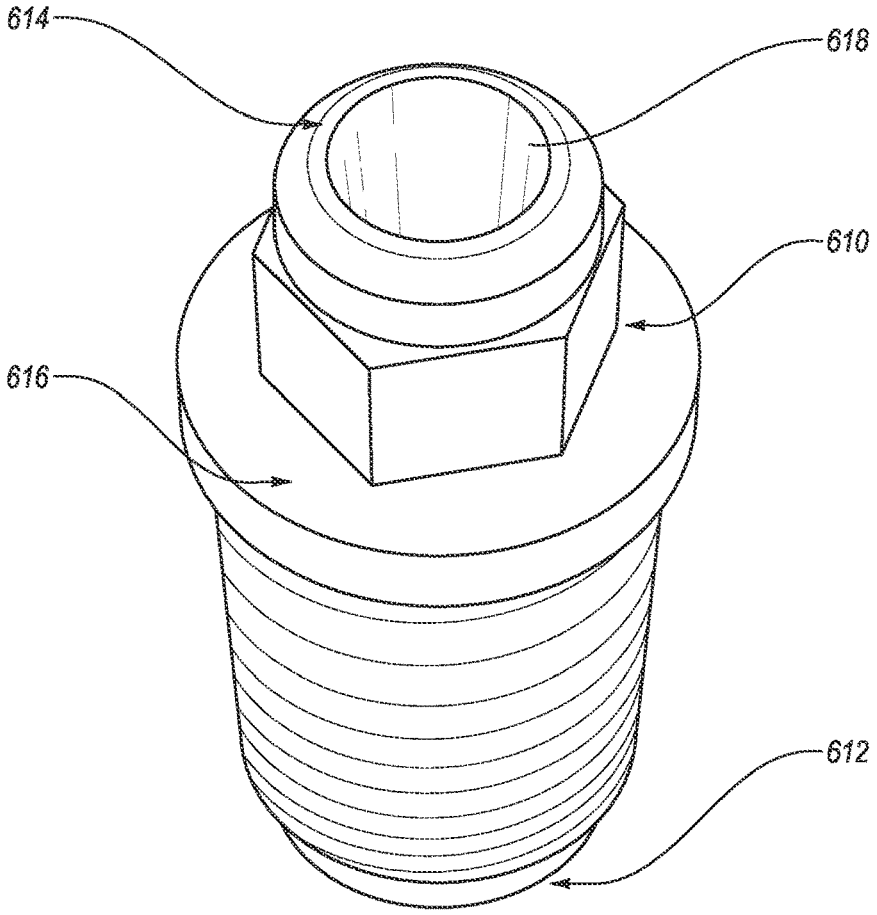
FIG. 2J illustrates the receiver side of the breach plug.

FIGS. 2I and 2J show the breach plug 610 with the powder side 612 and the primer side 614 adapted to hold the primer cap (e.g., also called a percussion cap on older muzzle loaders, such as side lock or other inline models). The powder side 612 is adapted to hold the powder or other charge material that causes the blast. The primer side 614 hold the primer cap that is stricken to cause the powder to ignite and fire the projectile out of the muzzle loader. The breach plug 610 includes a passageway between the powder side 612 and the primer side 614 so blast from the primer cap can ignite the powder on the powder side 612. Therefore, the breach plug includes a powder side 612, then the threading, then an annular collar 616, then a nut portion 618, and then the primer side 614 having the primer opening 618 for receiving the primer cap. FIG. 2I shows the barrel side that faces or inserts into the barrel and FIG. 2J shows the receiver side that faces inserts into the receiver.

Figure 3A:
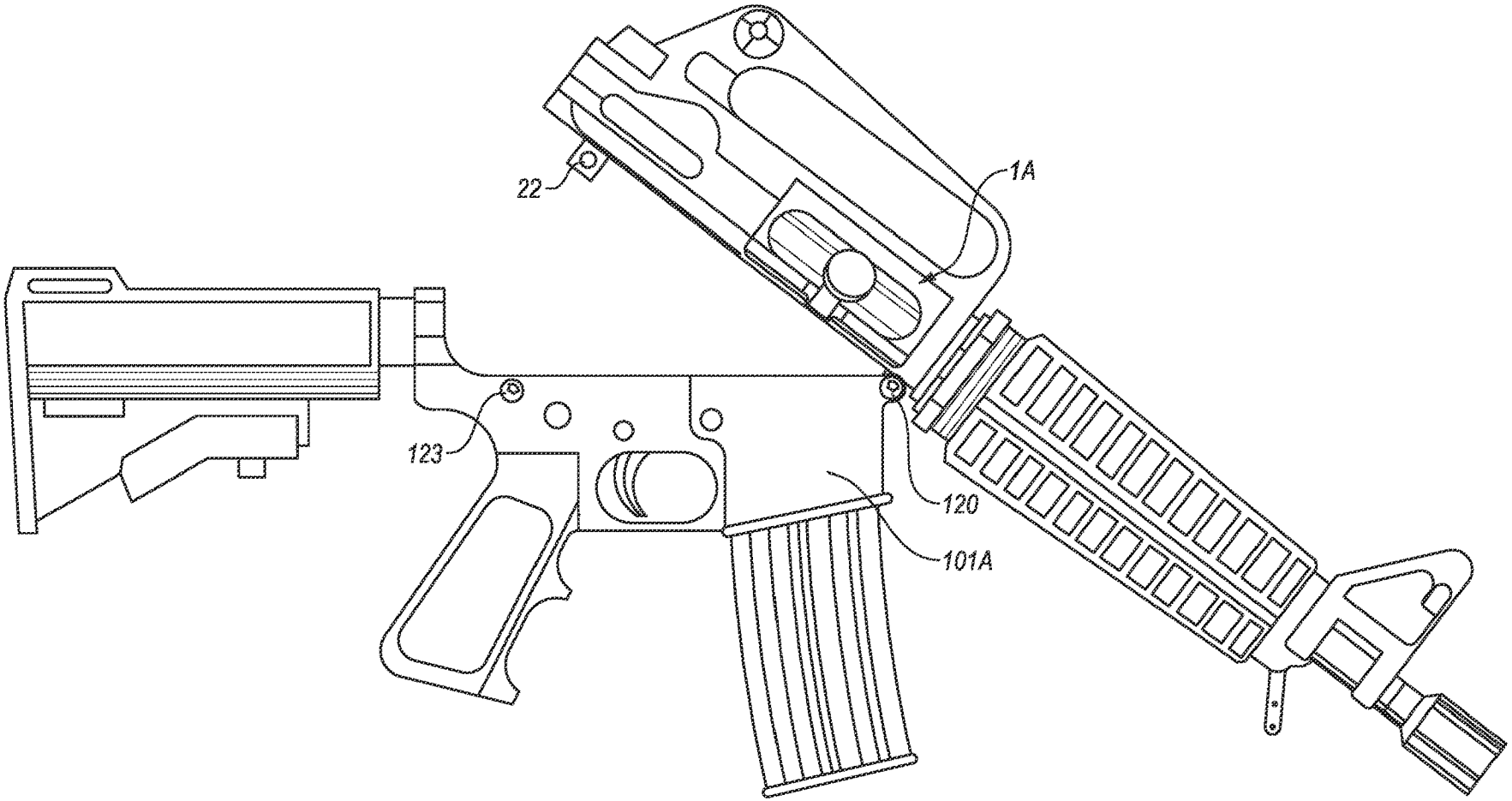
FIG. 3A illustrates a standard AR upper receiver assembly (semi-auto or full auto) being pivotally removed from a standard AR lower receiver assembly with the takedown pin removed therefrom.
Figure 3B:
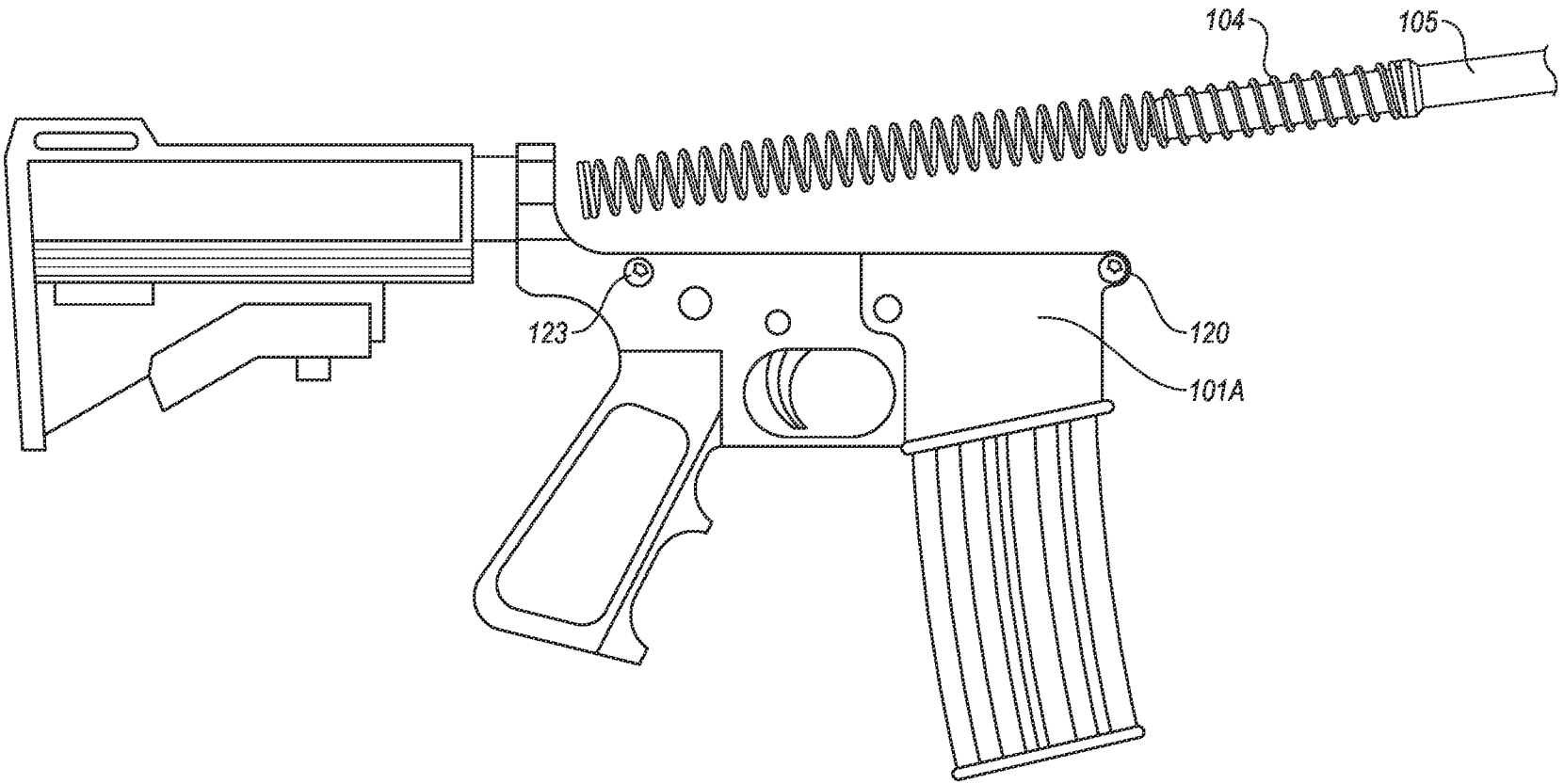
FIG. 3B illustrates a standard a standard AR lower receiver assembly.

FIG. 1 shows an AR-10 semi-automatic (AR-10 SA) with the pivot pin 120 and takedown pin 123 in the receiver holes to fasten the semi-automatic (SA) upper assembly 1A to the lower assembly 101A. FIG. 3A shows the takedown pin 123 removed from the upper assembly 1A so that the SA upper assembly 1A pivots on the pivot pin 120. FIG. 3B shows the pivot pin 120 removed so that the SA upper assembly (not shown) is detached from the lower assembly 101A. Optionally, the operating spring 104 can be removed or retained therein when the ML upper assembly 300 is mounted to the lower assembly. Performing the steps from FIG. 1 then FIG. 3A to FIG. 3B disassembles the AR-10 SA, and performing the steps from FIG. 3B to FIG. 3A then to FIG. 1 assembles the AR-10 SA. FIG. 3B shows the standard AR lower receiver alone. These steps can be followed with the muzzle loader upper receiver and standard AR lower receiver to form the muzzle loader AR rifle.

Accordingly, the present invention can include a ML upper assembly that mounts to a lower assembly to form an AR-10 ML rifle. The present invention can also include the AR-10 ML rifle having the ML upper assembly mounted to the standard AR lower assembly. The present invention can also include a kit including the standard AR lower assembly with the SA upper assembly and ML upper assembly. The present invention can also include a kit including the standard AR lower assembly with the SA upper assembly and ML upper assembly and bolt action (BA) upper assembly from the incorporated applications.

The present invention may also include a method of converting an AR-10 SA rifle into an AR-10 ML rifle. The present invention may also include a method of attaching a ML upper assembly to a lower assembly to form the AR-10 ML rifle. The present invention may also include a method of disassembling an AR-10 ML rifle into a ML upper assembly and a standard AR lower assembly. Other assemblies, guns, kits, systems, and methods of making/assembling or methods of disassembling are also included. The methods may include assembling and/or disassembling the ML upper assembly. The individual components of the ML upper assembly may also be embodiments of the invention.

Figure 4A:
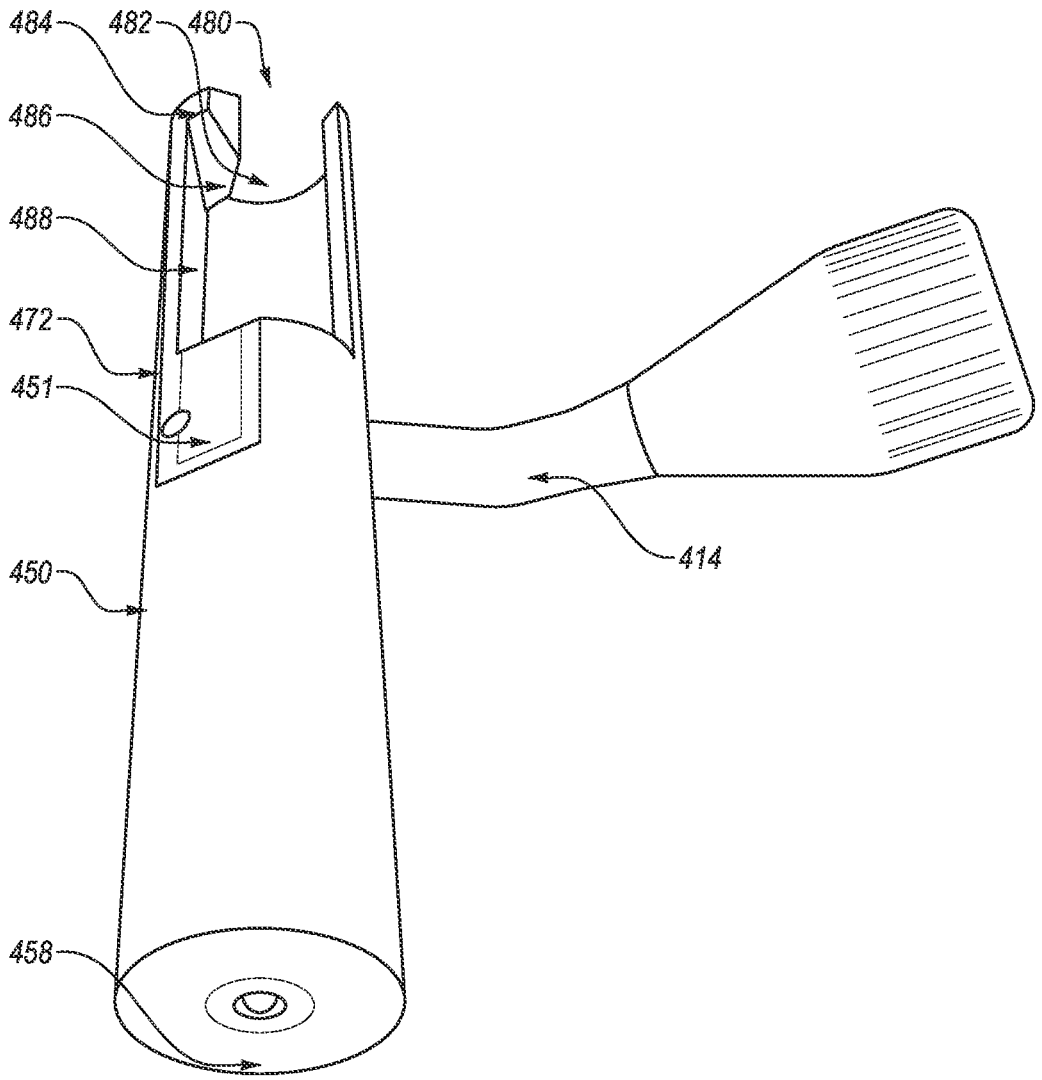
FIG. 4A illustrates a muzzle loader bolt.

FIG. 4A shows the bolt 450, which is adapted to include the firing pin (not shown) therein. The bolt 450 includes the bolt handle hole for coupling with the bolt handle 414, and whereby the bolt handle hole is aligned with the bolt handle slot 412 when the bolt 450 is in the receiver 402.

When included, the roll pin hole receives a roll pin (not shown), which holds the firing pin in. The firing pin is free floating. The firing pin can be any standard AR-10 firing pin. In one option, the firing pin can be a DPMS LR-308 AR firing pin, such as AR-10 (e.g., Armalite AR-10) or AR-15.

Opposite of the bolt tip 458 is a bolt end 480 that has a firing pin recess 482 for retaining the firing pin therein. The firing pin recess 482 at the bolt end 480 is next to an end ridge 484 with an end ramp 486. The end ridge 484 and end ramp 486 allow for operation of the rifle by setting the hammer in a locked position. The end ridge 484 keeps the hammer set in the locked position while the bolt 450 is in the open position all of the way forward. The end ramp 486 is what pushes the hammer back down while pushing the hammer forward after firing the rifle so that the hammer can again rest on the end ridge 484 before closing the bolt 450.

There is an end slot 488 at the firing pin recess 482 next to the end ramp 486, where the end slot 488 has a dimension D from the end ridge 484 and/or end ramp 486 and a dimension D1 from the end 480. The dimension D is configured for hammer clearance in the end slot 488. The dimension D1 is from the end and allows for operation, with the end ridge 484 extending from the body 472 to make the end slot 488 shaped as shown. The end ridge 484 can keep the gun from shooting by keeping the hammer set in the locked position, but once the hammer is in the end slot 488, the hammer can release. Thus, when the bolt 450 is open, the rifle can't shoot, but when the bolt 450 is closed the hammer is in the end slot 488 and the rifle is able to fire.

The AR has a swinging hammer that is received into the end slot 488, and which strikes the firing pin within the bolt 450. When the bolt 450 is drawn back, it pushes the hammer back, and the hammer pushing ridge (e.g., end ridge 484) sets the hammer.

Also, the bolt 450*b* can be substantially a cylinder with or without any plane or flat portion 451 as shown herein.

In some embodiments, a version of the bolt can be configured with a breach plug. Another embodiment of the bolt can be configured to hold the primer cap itself so that the breach plug can be devoid of holding the primer cap, where the bolt provides the primer cap into the breach plug.

In some embodiments, a primer cap extraction tool can be provided that includes a recessed end adapted to hold a primer cap for insertion into the breach plug and a forked end adapted for removing a the primer cap from the breach plug.

Figure 4B:
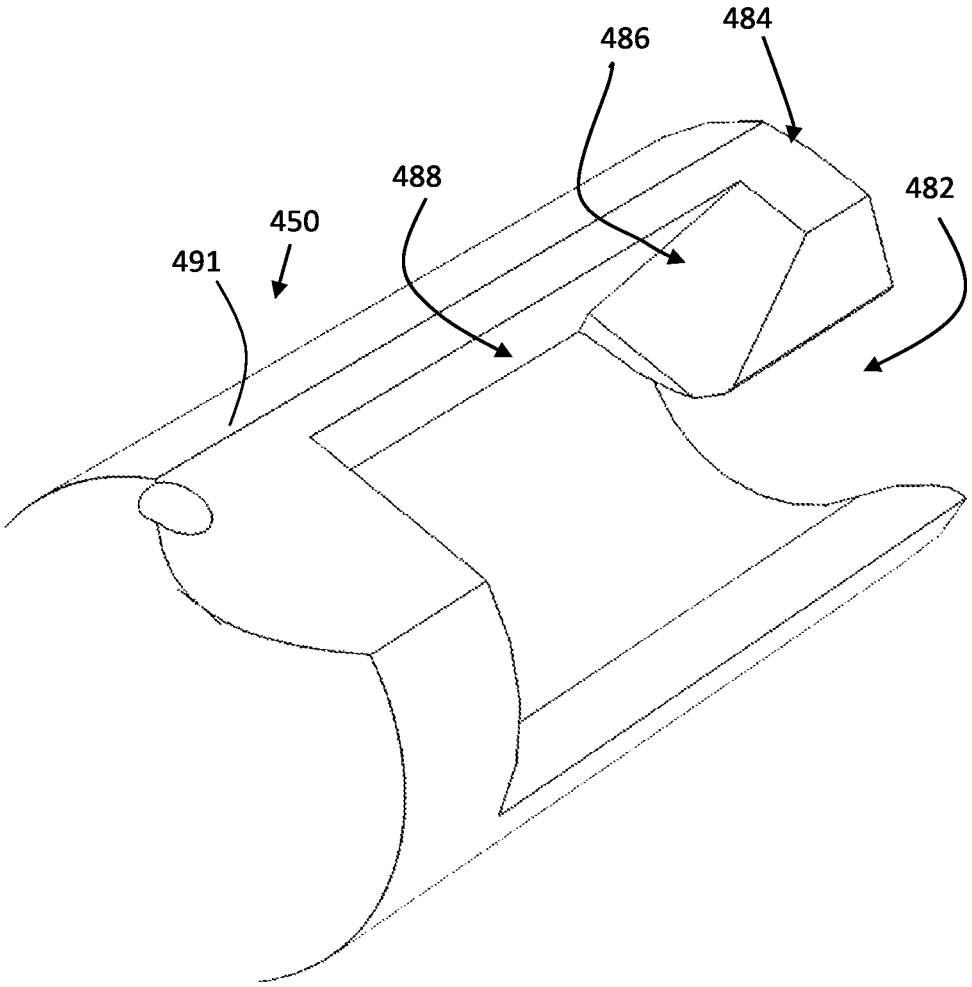
FIG. 4B illustrates a back portion of the muzzle loader bolt.

FIG. 4B shows that the tail end of the bolt 450 has the firing pin recess 482 and the end slot 488 at the firing pin recess 482 next to the end ramp 486, where the end slot 488 has a dimension D from the end ridge 484 and/or end ramp 486 and a dimension D1 from the end 482. The firing pin recess 484 is recessed into the tail end 480 of the bolt 950. The firing pin recess 484 also opens to the end slot 488. This forms an L shaped planar tail surface 991 and cooperative L shaped opening from the firing pin recess 482 and end slot 488. The firing pin recess and end slot 488 forming an L slot having an L shape defined by the L shaped planar tail surface 491, along with the corresponding end ramp 486.

There is an end slot 488 at the firing pin recess 482, where the end slot 488 has a dimension D from the end ridge 484 and/or end ramp 486 to the hammer pushing ridge 490. The dimension D is configured for hammer clearance in the end slot 488. The hammer pushing ridge 490 can keep the gun from shooting by preventing the hammer from setting, but once the hammer is in the end slot 488, the hammer can set. Thus, when the bolt 450 is open, the gun can't shoot, but when the bolt 450 is closed the hammer is in the end slot 488 and the gun is able to fire.

The AR has a swinging hammer that is received into the end slot 488, and which strikes the firing pin within the bolt 450. When the bolt 450 is drawn back, it pushes the hammer back, and the hammer pushing ridge 484 sets the hammer.

The dimension D is important for hammer clearance. The dimension D can be about 1", or +/−1%, 2%, 5%, or 10% for an AR-10; however, an AR-15 can have different values for the dimension D. When the bolt 450 is closed, it is in a position so that the hammer can swing the full length for firing the rifle. But when the bolt 450 is opened, the bolt holds the hammer so that it cannot strike the firing pin so that the rifle cannot fire. The hammer clearance D is dimensioned so that once the rifle has fired, you can still draw the bolt 4 back to get the hammer to cock again.

The end ramp 486 and end ridge 484 make sure that when the bolt 450 is not fully seated, the gun will not fire. While the hammer may be pulled forward, it is at an angle that does not hit the firing pin. When pushing the bolt 450 forward you can get to where the hammer is between the body and the end ramp 486, you can pull the trigger and the hammer will go off, but it can't hit the firing pin because it's on the wrong angle. So the gun still can't go off. Even if you close the bolt 450 all the way with the hammer forward, the gun is not going to go off. The bolt 450 has to be rotated and seated so that the bolt handle is seated in the bolt rest in order for the gun to fire. As such, the bolt 450 provides safety mechanisms so that the gun does not fire until the bolt is set with the bolt handle in the bolt rest.

Figure 5A:
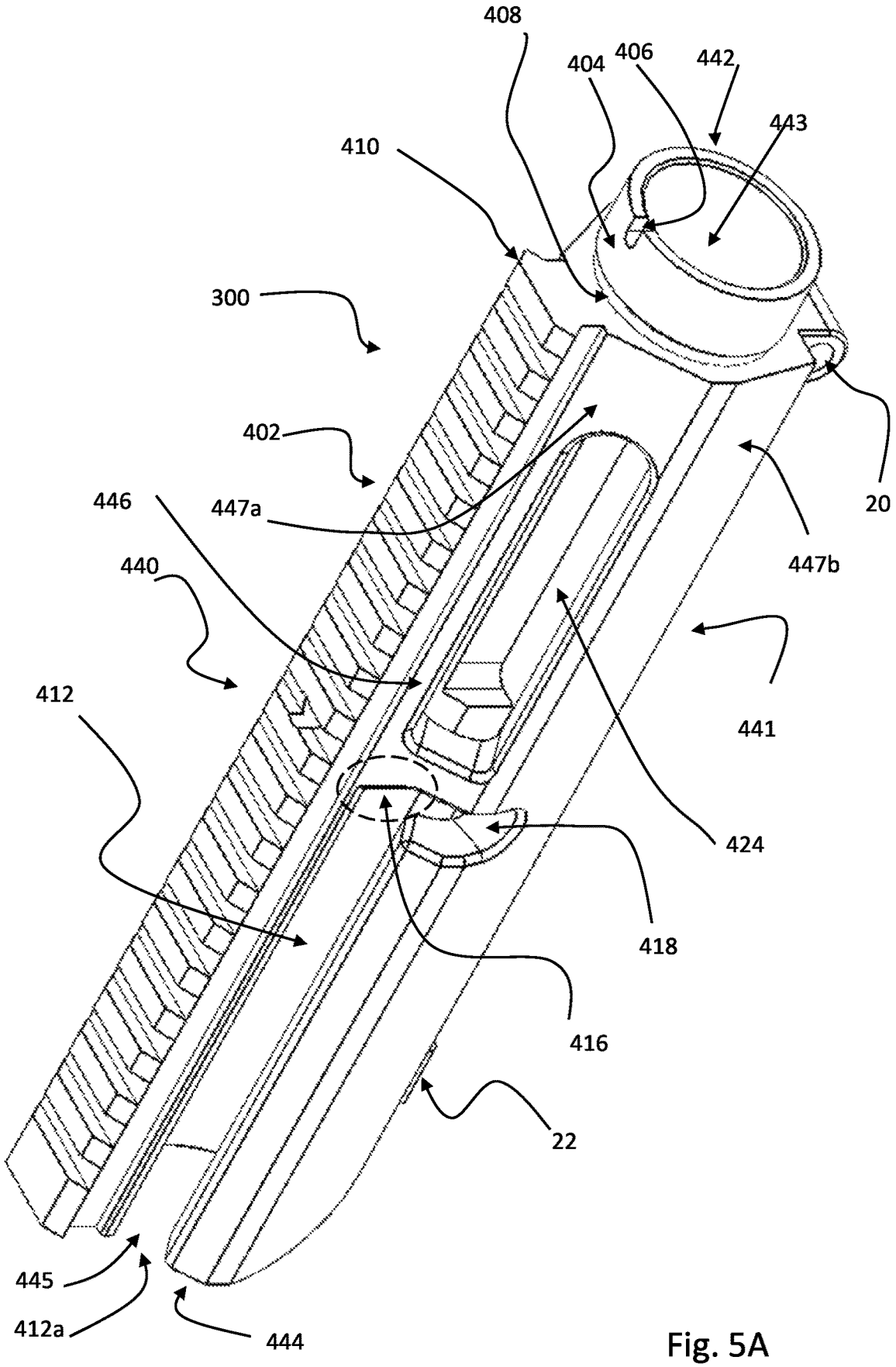
FIGS. 5A to 5D illustrate different views of an embodiment of a muzzle loader upper receiver configured to be coupled with a standard AR lower receiver assembly.
Figure 5B:
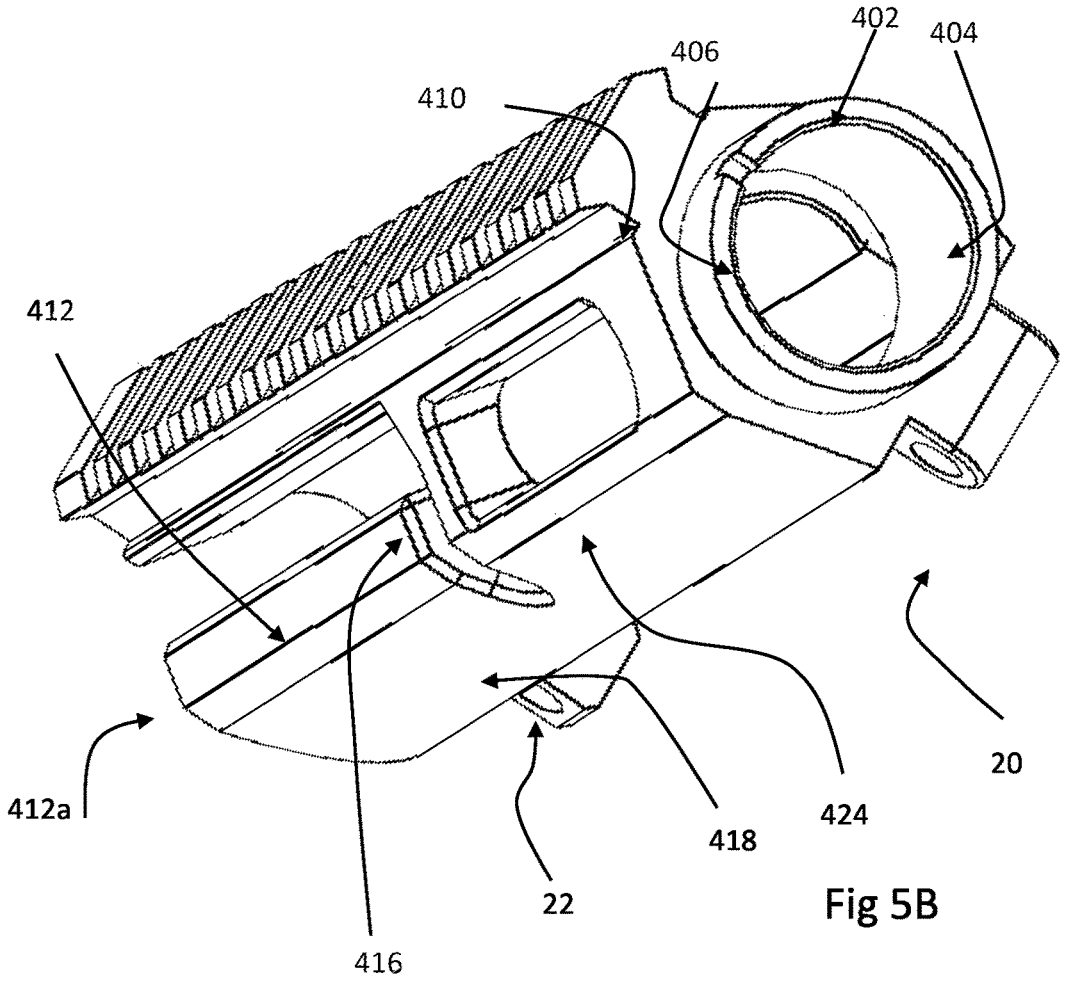
Figure 5C:
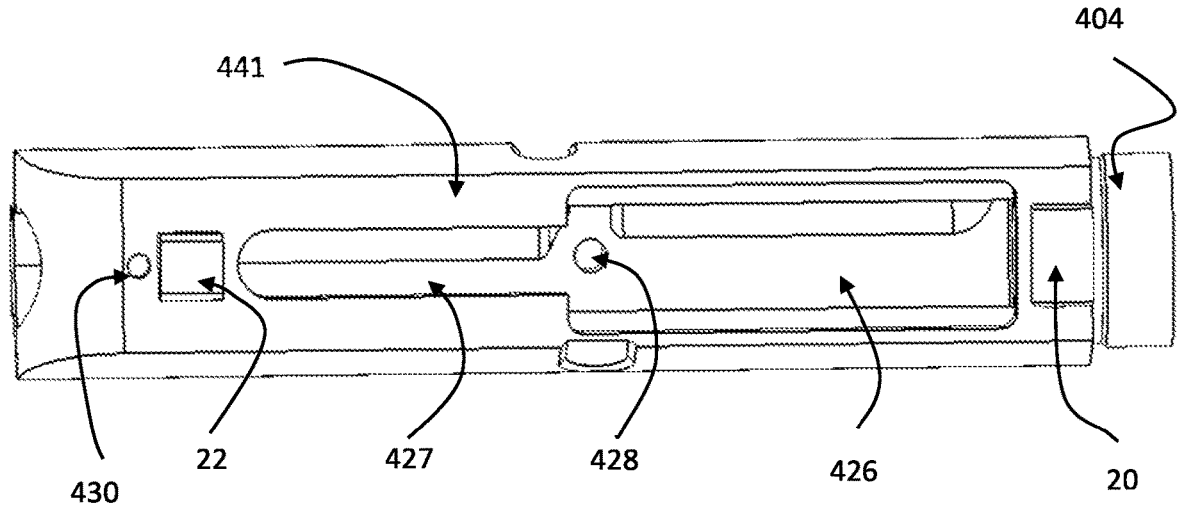
Figure 5D:
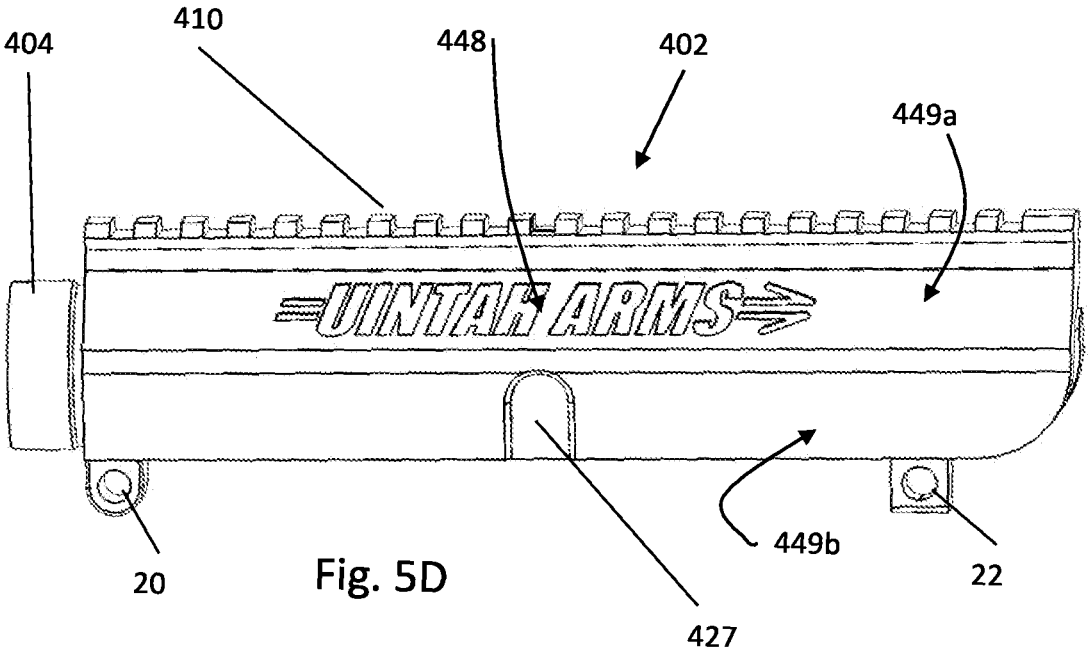

FIGS. 5A-5D show different views of the upper receiver 402 of a ML upper assembly 300, which is configured for muzzle loader firing. FIG. 5A shows a perspective view and FIG. 5C shows a bottom view of the upper receiver 402. The bottom view of FIG. 5C shows that the same magazines of an AR-10 SA may fit into the ML upper assembly 300 and thereby the AR-10 ML; however the ML upper assembly 300 may be devoid of the magazine slot because the muzzle loader has no use of a magazine. However, the illustrated upper receiver 402 is also usable in a bolt action AR, such as described in the incorporated references. FIG. 5D shows the other side of the upper receiver 402. This shows that the bolt action upper assembly of the incorporated applications can be used in the ML upper assembly 300. Accordingly, some aspects include a kit with the upper receiver 402 along with the bolt action bolt and the muzzle loader bolt. The kit could also include the barrels and other components for both the bolt action AR and the muzzle loader AR.

The receiver 402 includes a threaded receiver 404 for receiving the barrel, which threaded receiver 404 is shown without threading. A barrel coupling nut 420 (see FIGS. 2A-2D and 2E) is provided for coupling the barrel 4*a* into the receiver 402 by screwing onto threaded receiver 404 (shown without threading). The barrel coupling nut 420 as shown in FIG. 2E is adapted to be received onto the threaded receiver 404. The barrel 4*a* can be slid in and the barrel coupling nut 420 screwed into the receiver 402 to mount the barrel 4*a*.

FIGS. 5A-5D show a threaded relief 408 is behind the threaded receiver 404. The threaded receiver 404 includes a dowel pin receiver 406 that is configured to receive a dowel pin, where the dowel pin keys into the dowel pin receiver 406. The threaded receiver 404 is threaded the same as an AR upper receiver. The barrel 4*a* slides into the barrel coupling nut 420, and then the barrel coupling nut 420 screws into the receiver 402 into a tight fitting. Optionally, the dowel pin hole of the barrel extension nut 420 aligns with the dowel pin receiver 406, and then the dowel pin is received into the dowel pin hole and dowel pin receiver 406. The barrel coupling nut 420 (FIG. 2E) goes over the barrel 4A and tightens to the threaded receiver 404, where the barrel coupling nut 420 is on the outside and locks down the barrel 4*a* to the receiver 402. As such, the barrel 4*a* may be attached to the upper assembly 300 by sliding into the barrel coupling nut 420 that is then screwed to the receiver 402. A barrel coupling nut 420 can be used to attach the barrel 4*a* into the receiver 402.

FIG. 5A shows the receiver 402 having the picatinny rail 410 for scope adjustment, which has grooves for receiving a sight or scope. For example, the picatinny rail 410 can be configured with the 20 MOA slope, which allows for more accurate long distance shooting. The picatinny rail 410 also allows for better usage of internal adjustment mechanisms of a scope that can be attached thereto, which is beneficial for long distance shooting. Here, the picatinny rail 410 is integrated, but it could be a separate part. The reason why it is integrated is that the muzzle loader allows for longer range shooting with accuracy, which can be facilitated with the 20 minute slope of the rail 410. It also allows for more rigidity that enhances shooting accuracy.

The receiver 402 includes the upper pivot pin receiver hole 20 for receiving the pivot pin 120 and the takedown pin receiver hole 22 for receiving the takedown pin 123 as shown in other figures.

The receiver 402 is shown to include the bolt handle slot 412 for receiving the bolt handle 414 (FIGS. 2B and 4A), which bolt handle 414 can slide there along while actuating the muzzle loader for blast cap replacement. The distal end of the bolt handle slot 412 includes a ramp 416. The other end of the bolt handle slot 412 is open as shown at 412*a*. When the bolt handle 414 is in the bolt rest 418 and pulled down into it and seated, then the rifle can fire. If the bolt handle 414 is not all the way seated into bolt rest 418, the rifle will not fire. In some aspects, the bolt is designed to inhibit the hammer from properly actuating unless the bolt handle 414 is fully seated in the bolt rest 418, which is described in more detail herein.

The extractor ramp 416 (in dashed circle) is angled from the bolt rest 418 toward the bolt handle slot 412, which was designed to facilitate extraction of the brass from the ejection port 424 for the bolt action upper receiver. Here, the same receiver 402 can be used for the muzzle loader upper receiver and the bolt action upper receiver. It should be recognized that the receiver 402 may be modified to remove features used for the bolt action that are not used for the muzzle loader configuration. As can be seen, the bolt rest 418 and bolt handle slot 412 are at roughly 90 degrees, however, the distal or forward edge (e.g., opposite of 412*a*) has the extractor ramp 416 at an angle between the bolt rest 418 and bolt handle slot 412 instead of a 90 degree angle. This extractor ramp 416 is provided to push the bolt handle 414 in an amount and direction that was configured to initiate extraction of the brass from the chamber when in the bolt action upper receiver. As such, the muzzle loader upper receiver can omit the features for brass ejection due to not using shells. The action of the bolt still is useful for application of the charge or blast caps and withdrawal of used blast caps that are used for the muzzle loader.

The extractor ramp 416 also facilitates easier proximal or backward pulling of the bolt handle 414. In some instances if heating occurs, upon manipulating the bolt handle 414 from the bolt rest 418 into the extractor ramp 416 can cause the bolt handle 414 to be pushed proximal or backwards toward the shooter to allow for a new charge (e.g., primer cap) to be installed into the charge recess of the barrel 4*a*.

Also shown in FIGS. 5A-5D are the top 440, bottom 441, distal end 442 having the barrel opening 443, proximal end 444 having the bolt opening 445, the first side 446 having the first side upper surface 447*a*, first side lower surface 447*b*, and second side 448 (e.g., having a logo or other indicia) having the second side upper surface 449*a* (e.g., containing the logo or other indicia as shown) and second side lower surface 449*b*.

FIG. 5B shows a perspective view of some of the features of the receiver 402.

FIG. 5C shows the bottom of the receiver 402, and shows the magazine slot 426 configured for receiving the magazine, which within includes the detent ball 428. The magazine slot 426 opens into the hammer slot 427 (e.g., hammer slot 427 narrower, proximal, and fluid with the magazine slot 426) configured for allowing the hammer to actuate therethrough. The detent ball 428 (in a detent recess) matches a recess 432 in the bolt 450 so that the bolt 450 stays closed and does not rattle open or rattle around during use. There is a spring in the detent recess that resiliently pushes the detent ball 428 outward so that the detent ball 428 can be pushed into the detent recess. The magazine slot can be omitted in some embodiments of the receiver 402 that are specific for a muzzle loader or are not usable with a bolt action. On the other hand, the receiver 402 can be disassembled and reassembled as either a bolt action embodiment or a muzzle loader embodiment as per the disclosure herein and in the incorporated references.

Near the upper takedown pin receiver hole 22, there is a threaded hole 430. The threaded hole 430 is adapted to receive a bolt therein so that the receiver 402 can be bolted to the lower assembly, where a fastener (e.g., threaded fastener, such as a screw, etc.) can be passed through the lower assembly into the receiver 402 and threaded into the threaded hole 430. This can increase rigidity of the mounted receiver 402 into the lower assembly and increase accuracy of firing. Such a coupling with a fastener is optional, and if used is removed along with the takedown pin 123 and pivot pin 120.

FIG. 5D shows the other side of the receiver 402, which shows the magazine release receiver recess 427, which receives the magazine release button. It should be noted that the receiver 402 is contoured to fit into the lower assembly, such as the back being rounded for a tight fitting.

Figure 6:
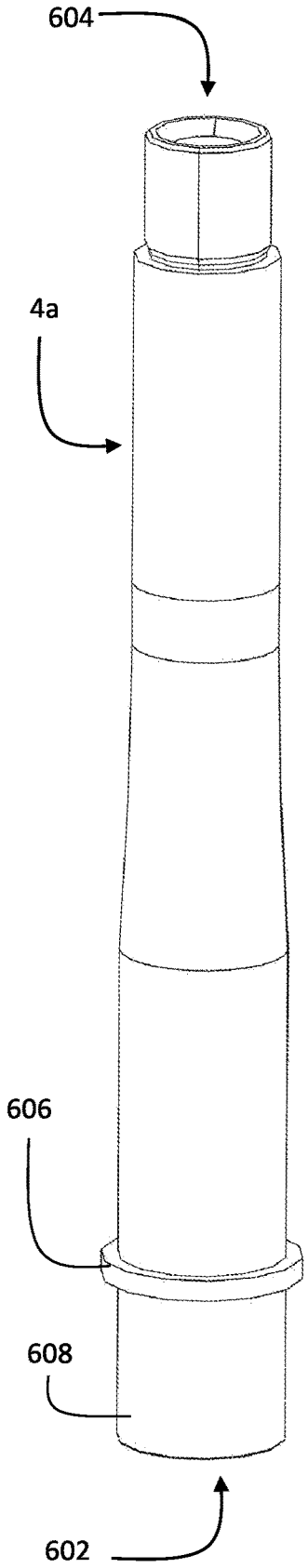
FIG. 6 illustrates a muzzle loader barrel.

FIG. 6 shows a barrel 4*a* having a back end 602 opposite of the muzzle end 604. The barrel 4*a* includes an annular ridge 606 a distance from the back end 602 as shown, where a cylindrical portion 608 extends from the annular ridge 606 to the back end 602. The cylindrical portion can fit into the receiver, such as in the opening 443. The annular ridge 606 allows the barrel nut 420 to hold the barrel 4*a* to the receiver 402.

FIGS. 7A-7E show another embodiment of a shortened bolt 702 that can be used in the ML upper receiver assembly 300. The shortened bolt 702 is stubbed at about the handle 714, so that it is shorter and takes up less space and is made of less material. The shortened bolt 702 can operate sufficiently with the muzzle loader configuration. The shortened bolt 702 includes a bolt tip 758 is a bolt end 780 that has a firing pin recess 782 for retaining the firing pin 704 therein. The firing pin recess 782 at the bolt end 780 shows the rear end of the bolt 702 so that the rear end of the firing pin 704 is visible. The bolt tip 758 shows the tip of the firing pin 704 within a bolt tip recess 759. Accordingly, the shortened bolt 702 can be similar to bolt 450 with the rear end portion behind the handle omitted, which results in a simple bolt 704 for use with the muzzle loader.

Figure 7A:
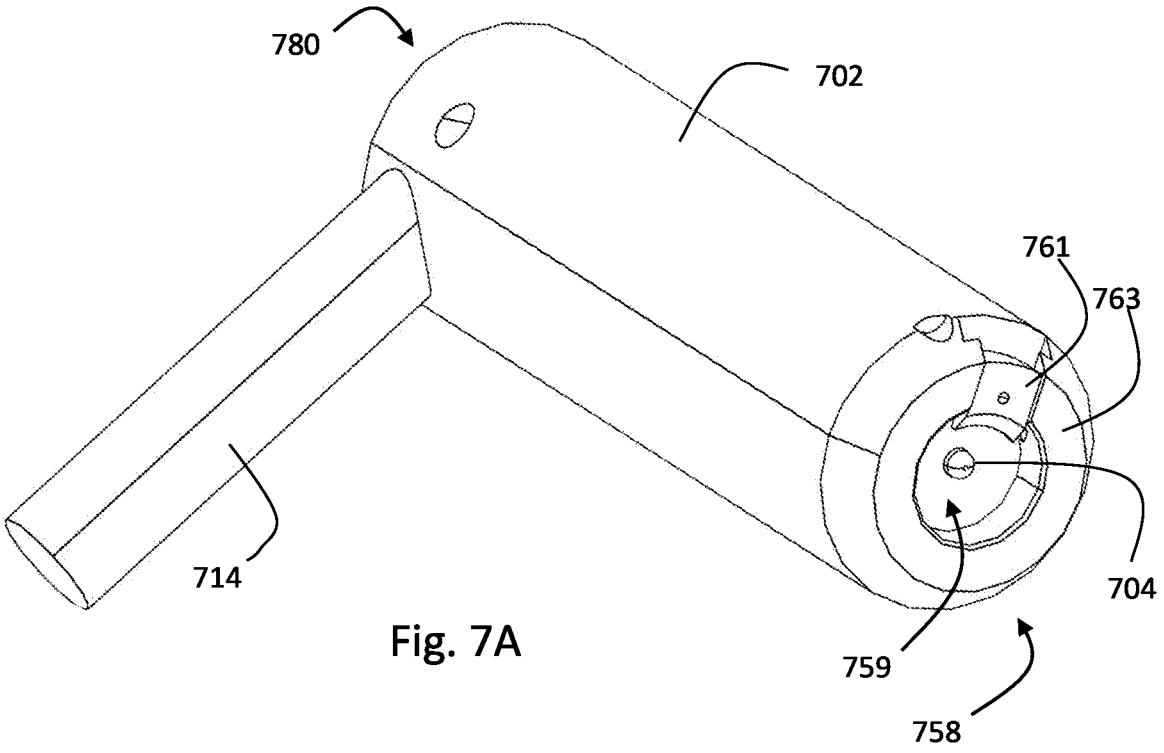
FIGS. 7A-7E illustrate different views of an embodiment of a muzzle loader bolt with reduced length.

FIG. 7A show the bolt tip 758, which includes the bolt tip recess 759 having an extractor 761 as part of the annular lip 763. FIG. 7E shows the bolt tip 759 without the extractor 761 in the extractor slot 765. The firing pin 704 is also shown.

Figure 7B:
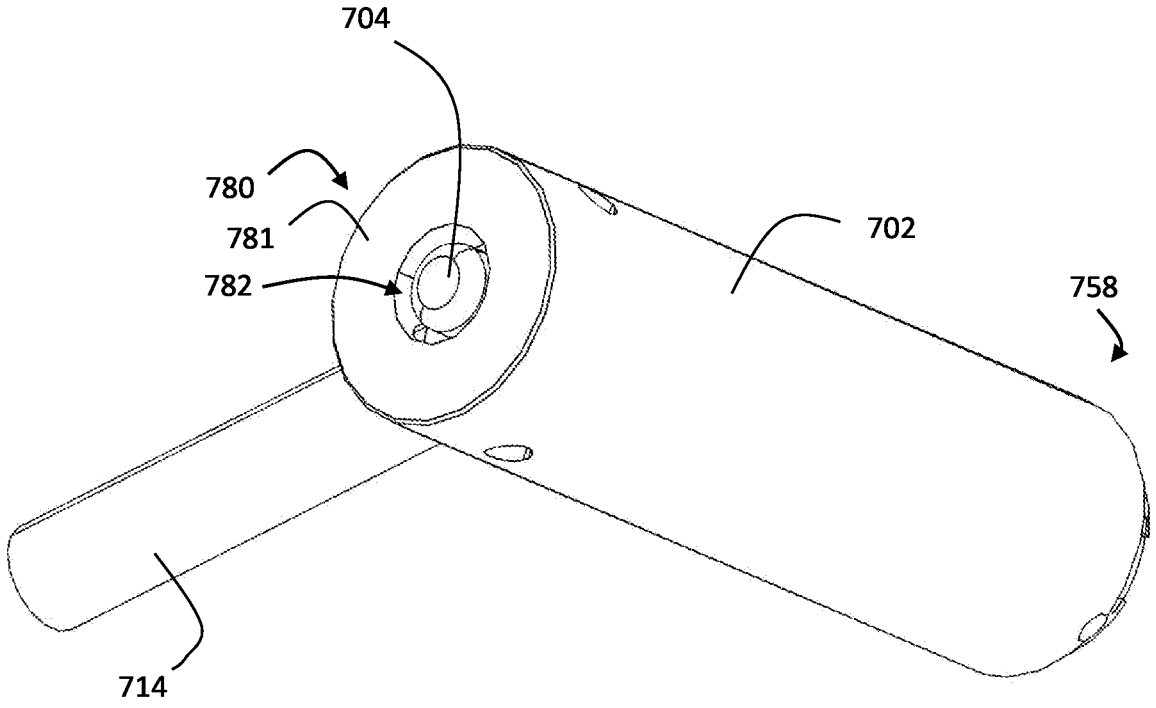

FIG. 7B shows the bolt end 780 that has the firing pin recess 782 with the firing pin 704 located therein. The handle 714 is adjacent to the bolt end 780, such as adjacent to the bolt end surface 781.

Figure 7C:
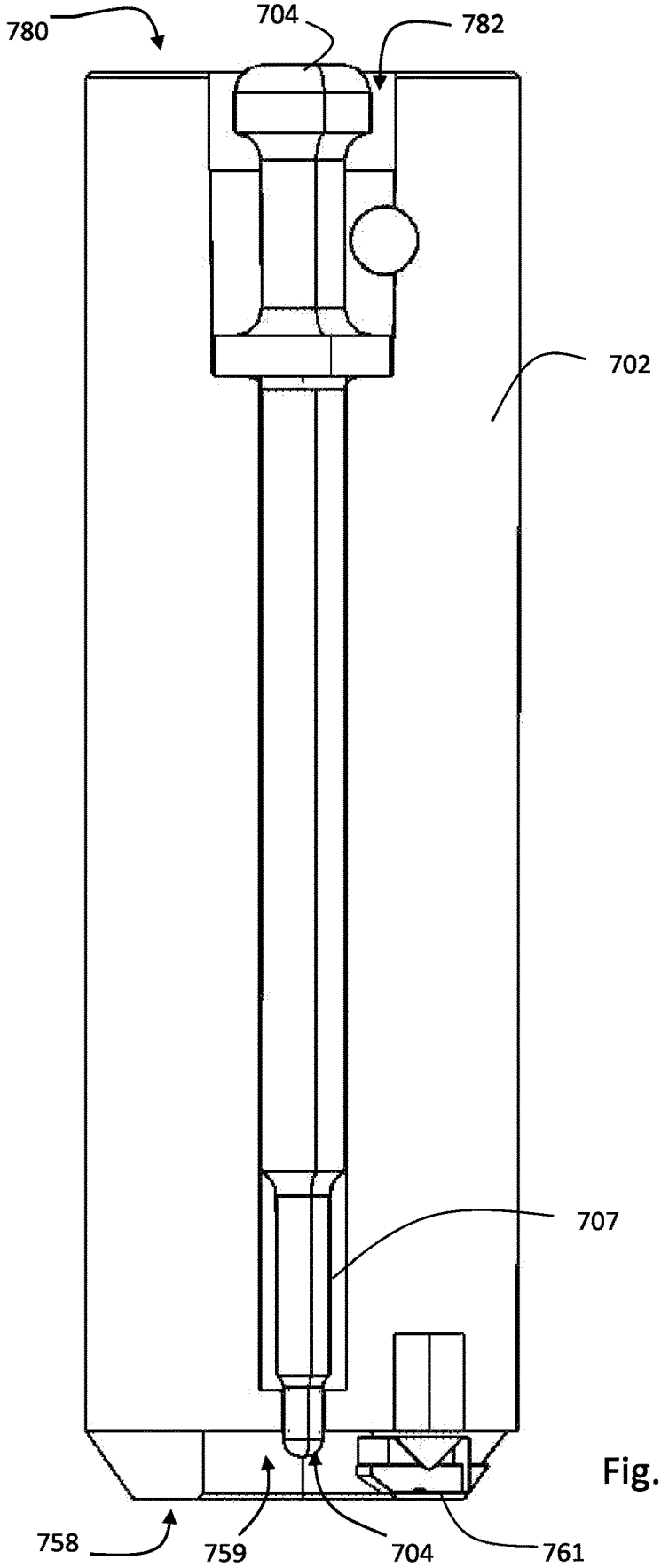

FIG. 7C shows a cross-sectional view of the bolt 702 with the firing pin 407 in the firing pin recess 780 and extending to the bolt tip recess 759 of the bolt tip 758. The extractor 761 is also shown, along with the recess for the screw that fastens it to the bolt 702. The pin channel 707 is shown to have different dimensions to accommodate different dimensions of the pin 704.

Figure 7D:
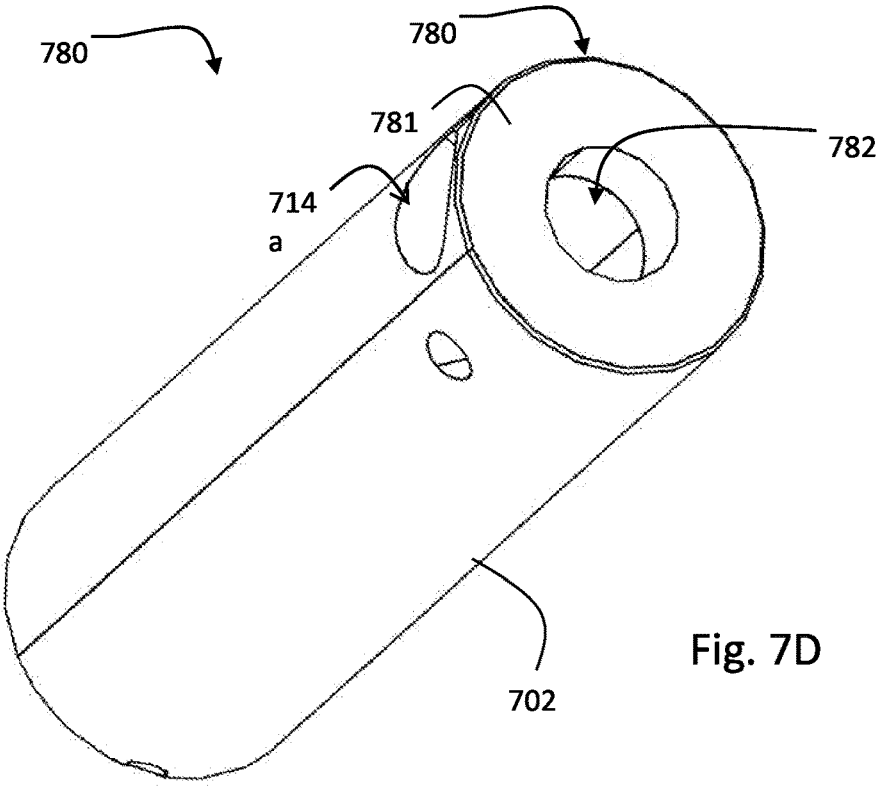
Figure 7E:
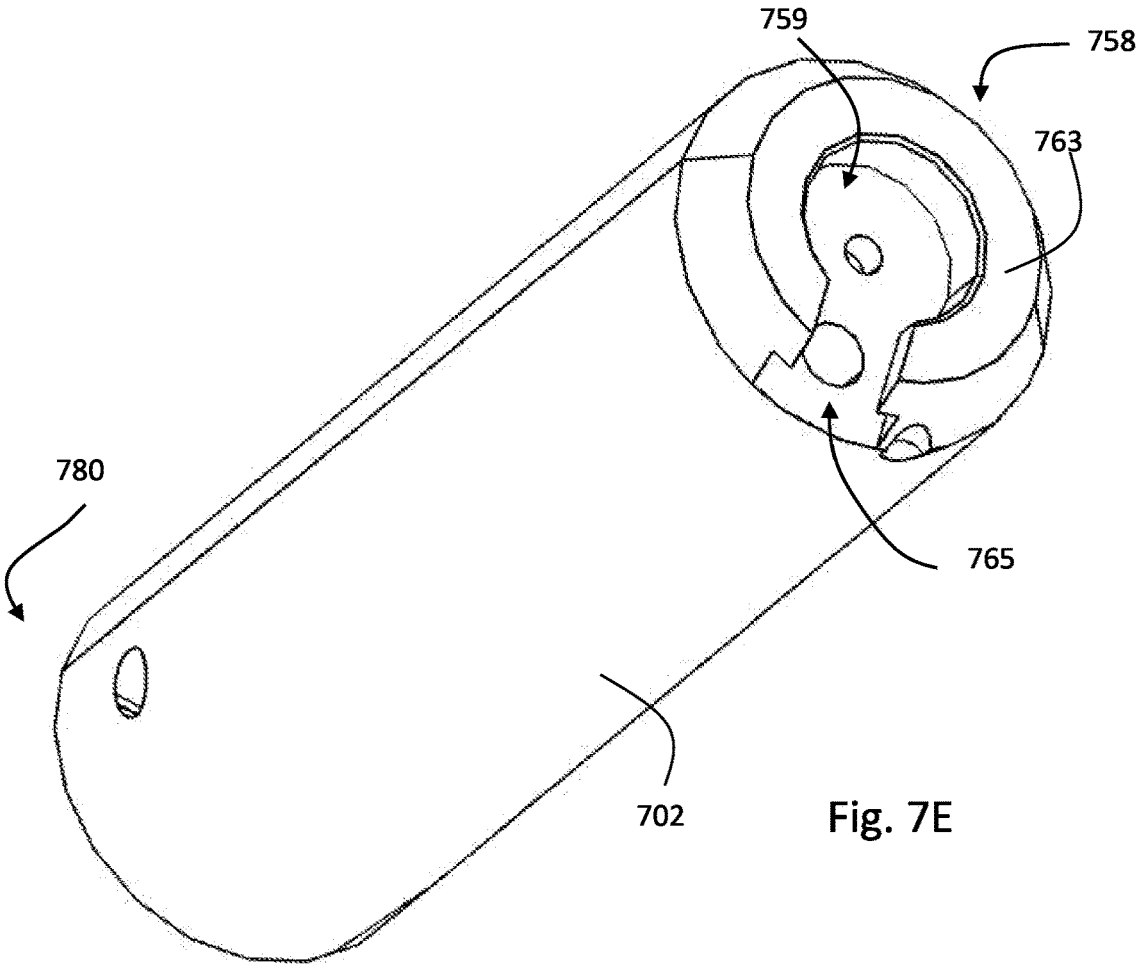

FIG. 7D shows the bolt end 780 with the open recess 782. The handle receiver opening 714*a* is also shown adjacent to the bolt end surface 781.

FIG. 7E shows the bolt tip 758 with the extractor slot 765 in the annular lip 763.

Figure 8A:
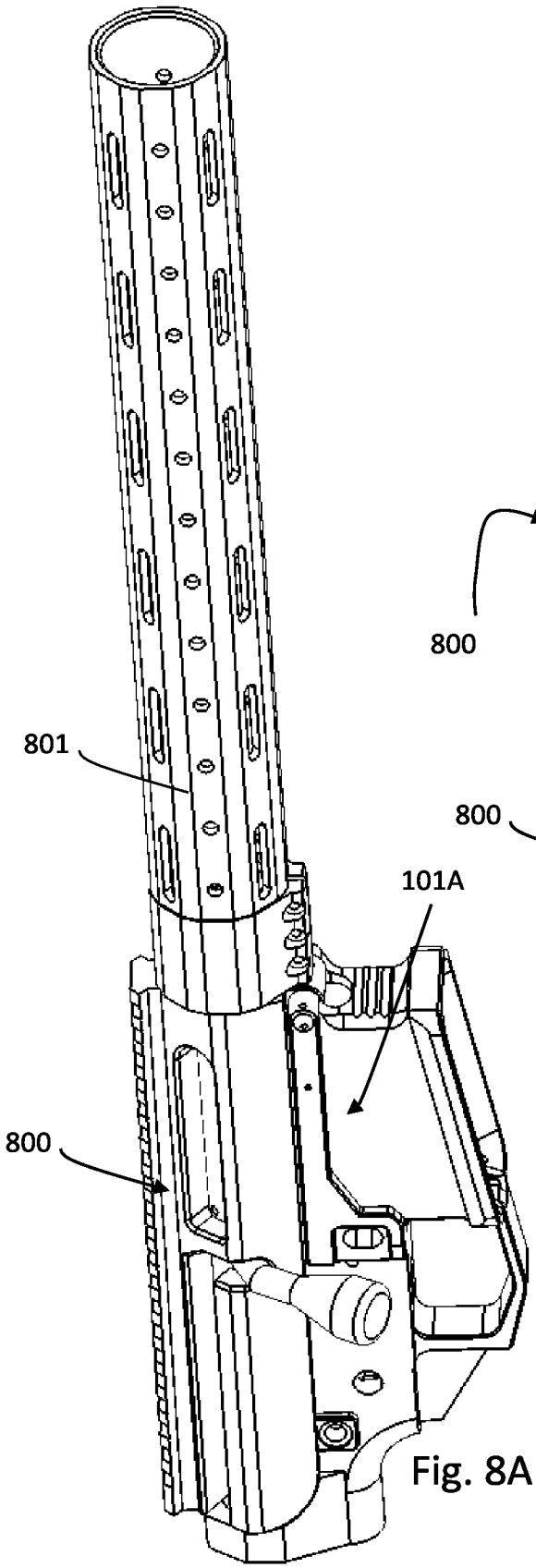
FIGS. 8A and 8B illustrate an embodiment of a muzzle loader upper receiver assembly coupled with a standard AR lower receiver assembly.
Figure 8B:
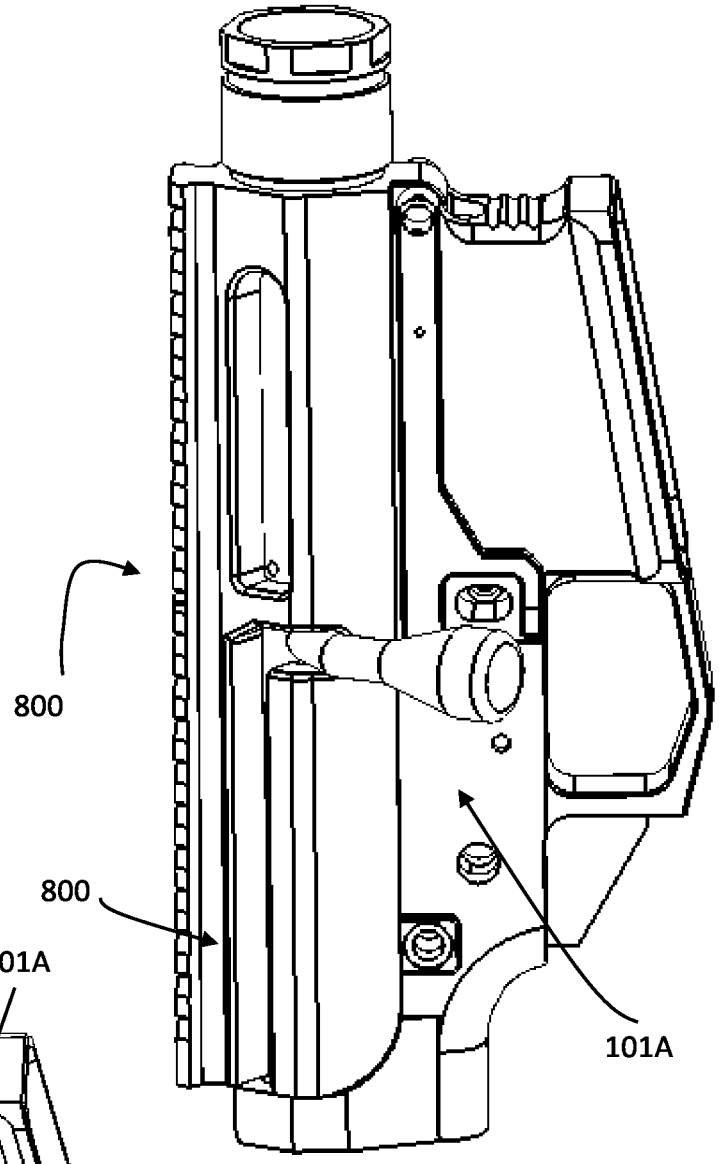
Figure 8C:
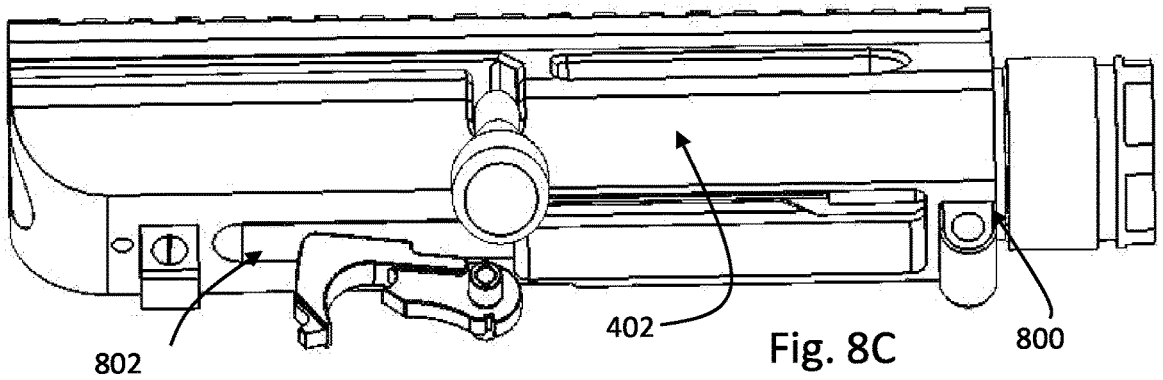
FIGS. 8C-8E show the muzzle loader upper receiver having the bolt in sequentially rotated views.
Figure 8D:
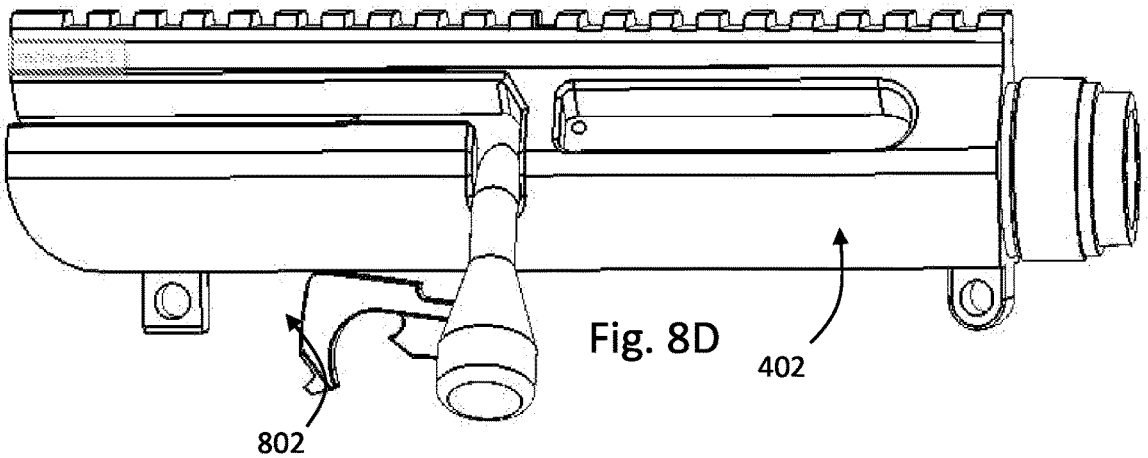
Figure 8E:
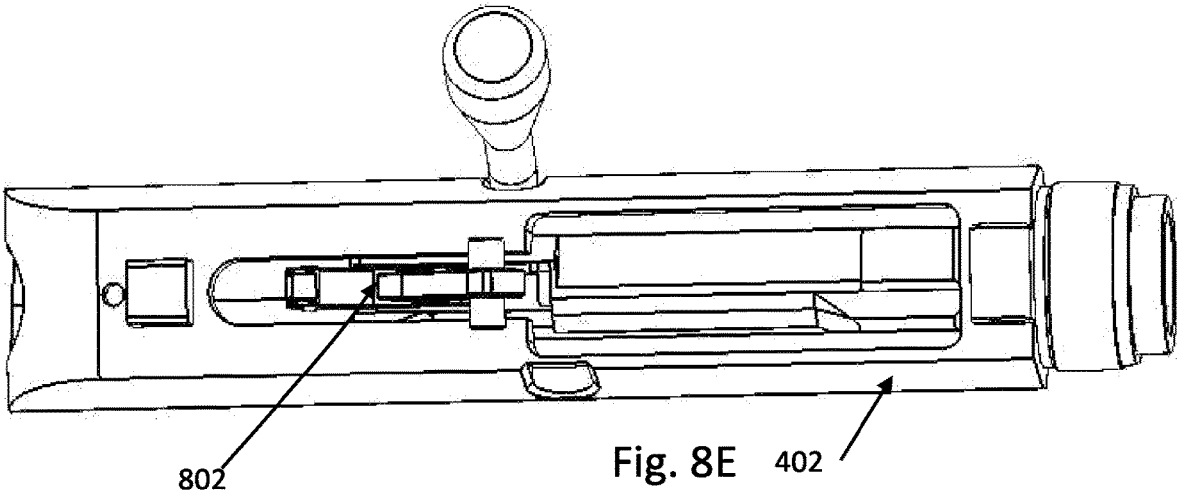

FIGS. 8A-8E show portions of the muzzle loader upper assembly 800 mounted to the standard lower assembly 101A, with and without the barrel guard 801. These figures show the arrangement of the elements as described herein. From FIGS. 8A to FIG. 8F, various components are removed so that the arrangement of the outer components can be viewed relative to the inner components. For example, FIG. 8C shows the relationship of the hammer assembly 802 relative to the upper assembly 800 with respect to the receiver 402. FIG. 8D shows a rotation from the view of FIG. 8C. FIG. 8E shows a rotation from the view of 8D.

In some embodiments, the present invention relates to a muzzle loader AR upper assembly as shown in the figures. The muzzle loader AR upper assembly can include a muzzle loader AR upper receiver as shown in one of the figures. The muzzle loader AR upper assembly can include a bolt of one of the figures in the AR upper receiver. In some aspects, the invention can include a muzzle loader AR upper receiver as shown in the figures. In some aspects, the invention can include a bolt for a muzzle loader AR upper receiver as shown in the figures. In some aspects, a muzzle loader AR upper assembly as shown in the figures is configured to be compatible with an AR DPMS LR-308 pattern or Armalite AR-10 pattern. In some aspects, a muzzle loader AR upper assembly is configured to be connectable with an AR lower assembly via two connection points. In some aspects, the muzzle loader AR upper assembly is configured to be connectable with an AR-10 lower assembly. In some aspects, the muzzle loader AR upper assembly is configured to be connectable with an AR-15 lower assembly. In some aspects, a muzzle loader AR upper assembly is configured to be connectable with an AR lower assembly through a pivot pin system and a takedown pin system. In some aspects, a muzzle loader AR upper assembly or upper receiver can have an upper pivot pin receiver hole that couples with a lower pivot pin receiver hole of an AR lower assembly or lower receiver via a pivot pin. In some aspects, a muzzle loader AR upper assembly or upper receiver can have an upper takedown pin receiver hole that couples with a lower take down pin receiver hole of an AR lower assembly or lower receiver via a takedown pin. In some aspects, a muzzle loader AR upper assembly or upper receiver can have: an upper pivot pin receiver hole that couples with a lower pivot pin receiver hole of an AR lower assembly or lower receiver via a pivot pin; and an upper pivot pin receiver hole that couples with a lower pivot pin receiver hole of an AR lower assembly or lower receiver via a pivot pin.

In some embodiments, a muzzle loader upper receiver can be configured to couple with an AR lower receiver. The muzzle loader upper receiver can include a unitary body having: a barrel end having a threaded receiver; a bolt receiving end opposite of the threaded receiver; an internal chamber extending from the bolt receiving end to the barrel end that is adapted to slidably receive a bolt therein so that the bolt can slide during actuation; a bolt handle slot extending from the bolt receiving end to a bolt rest recess, wherein the bolt handle slot opens from the internal chamber, the bolt rest recess being orthogonal with the bolt handle slot; an extractor ramp at an end of the bolt handle slot opposite of the bolt receiving end, the extractor ramp transitioning from a side of the bolt handle slot to the bolt rest recess; an ejector port opening from the internal chamber and being positioned between the bolt handle slot and barrel end; a magazine slot on the bottom of the unitary body that opens from the internal chamber, where the magazine slot narrows to a hammer slot toward the bolt receiving end (which magazine slot can be omitted in the muzzle loader configuration); an upper pivot pin receiver hole at the barrel end; and an upper takedown receiver hole at the bolt receiving end. In one aspect, the muzzle loader upper receiver can include a picatinny rail opposite of the magazine slot. In one aspect, the picatinny rail has a 20 MOA slope. This configuration can be used for a muzzle loader or for a bolt action upper receiver.

In some embodiments, a muzzle loader upper assembly is provided that couples to an AR lower assembly. The muzzle loader upper assembly can include the muzzle loader upper receiver of one of the embodiments and the bolt of one of the embodiments within the receiver lumen of the muzzle loader upper receiver.

In some embodiments, a muzzle loader AR rifle can include a standard AR lower assembly having a lower pivot pin receiver hole and a lower takedown pin receiver hole and a muzzle loader upper assembly of one of the embodiments coupled to the standard AR lower assembly by having a pivot pin in the upper and lower pivot pin receiver holes and a takedown pin in the upper and lower takedown pin receiver holes.

In some embodiments, a method of converting an AR rifle to a muzzle loader AR rifle can include: removing a standard AR upper assembly from a standard AR lower assembly; and mounting the muzzle loader upper assembly of one of the embodiments to the standard AR lower assembly by placing a pivot pin in the upper and lower pivot pin receiver holes and a takedown pin in the upper and lower takedown pin receiver holes. Also, a bolt action AR can be taken apart so that the muzzle loader upper receiver can be mounted to the standard AR lower receiver.

In some embodiments, a method of assembling a muzzle loader AR rifle can include: mounting the muzzle loader upper assembly of one of the embodiments to the standard AR lower assembly by placing a pivot pin in the upper and lower pivot pin receiver holes and a takedown pin in the upper and lower takedown pin receiver holes.

In some embodiments, a muzzle loader AR rifle can include: a muzzle loader AR pattern upper receiver; a muzzle loader barrel coupled to the muzzle loader AR pattern upper receiver; and an AR pattern lower receiver coupled to the muzzle loader AR upper receiver, wherein the lower receiver includes a trigger. In some aspects, a bolt can be in the muzzle loader AR pattern upper receiver. The muzzle loader AR rifle can include one or more of the following: a takedown pin hole and a pivot pin hole in an AR configuration; a ramrod coupled to the muzzle loader upper receiver; the muzzle loader barrel includes a breach plug opposite of a muzzle barrel open end; the muzzle loader barrel includes a protruding annular ridge on an external surface thereof proximal to the breach plug end with a region between the annular ridge and breach plug end surface, wherein the annular ridge on the barrel receives a barrel coupling nut that couples the muzzle loader barrel with the muzzle loader AR pattern upper receiver. In some aspects, the breach plug is screwed into the breach plug end of the muzzle loader barrel. Optionally, the breach plug has a charge side facing the muzzle barrel open end and a primer side facing away from the muzzle barrel open end. In some aspects, the breach plug includes a primer cap slot for holding a primer cap. In some aspects, the breach plug includes a nut portion adjacent to the primer cap slot. In some aspects, the breach plug includes a threading that matches a threading of the breach plug end of the muzzle loader barrel. In some aspects, the breach plug includes a conduit from the primer cap side to the charge side. In some aspects, the breach plug omits the primer cap slot, and the bolt includes a primer cap slot. In some aspects, the muzzle loader bolt is mostly cylindrical.

In some embodiments, a muzzle loader upper receiver can be configured to be coupled with a standard AR lower receiver. The muzzle loader upper receiver can include a unitary receiver body having a receiver lumen. The unitary receiver body can have a top; a proximal end having a bolt opening with the bolt of one of the embodiments located therein; a distal end having a barrel opening; and a bottom.

The bottom can include: a hammer slot; a takedown pin receiver hole at a proximal end, the takedown pin receiver hole being orthogonal with the hammer slot; and a pivot pin receiver hole at a distal end, the pivot pin receiver hole being orthogonal with the hammer slot, the pivot pin receiver hole being parallel with the takedown pin receiver hole. A first side of the upper receiver can include a bolt handle slot extending from the bolt opening and a bolt rest slot extending from the bolt handle slot. In some options, the bottom of the upper receiver has a magazine slot open to and longitudinally aligned with the hammer slot, the hammer slot being narrower than the magazine slot. In some aspects, the first side has an ejection port between the bolt handle slot and distal end. In some aspects, the magazine slot is omitted.

In some embodiments, a muzzle loader upper receiver assembly can include a muzzle loader upper receiver configured to be coupled with a standard AR lower receiver. The muzzle loader upper receiver can include a unitary receiver body having a receiver lumen. The unitary receiver body can have: a top; a proximal end having a bolt opening; and a distal end having a barrel opening. The receiver can include a bottom comprising: a hammer slot; a first side having: a bolt handle slot extending from the bolt opening and exposing a portion of the receiver lumen; a bolt rest slot extending from the bolt handle slot; and the bolt of one of the embodiments slidably located in the receiver lumen.

In some embodiments, the muzzle loader upper receiver assembly can include a muzzle loader upper receiver configured to be coupled with a standard AR lower receiver. The muzzle loader upper receiver can include a unitary receiver body having a receiver lumen. The unitary receiver body can have: a top; a proximal end having a bolt opening; and a distal end having a barrel opening. The receiver can include a bottom with a magazine slot open to and longitudinally aligned with a hammer slot, the hammer slot being narrower than the magazine slot. The receiver can include a first side having: a bolt handle slot extending from the bolt opening and exposing a portion of the receiver lumen; a bolt rest slot extending from the bolt handle slot; and an ejection port between the bolt handle slot and distal end. The receiver can include a second side. The receiver can include the bolt of one of the embodiments slidably located in the receiver lumen. The magazine slot can be omitted in some embodiments.

In some embodiments, a method of forming a muzzle loader rifle can include: providing a muzzle loader AR upper receiver; and coupling the muzzle loader AR upper receiver to an AR pattern lower receiver. The method can include coupling the muzzle loader barrel to a barrel opening of the muzzle loader AR pattern upper receiver. Alternatively, the muzzle loader AR upper receiver is provided with a muzzle loader barrel coupled to a barrel opening of the muzzle loader AR pattern upper receiver. In some aspects, a bolt is in the muzzle loader AR pattern upper receiver. In some aspects, the muzzle loader AR pattern upper receiver includes a takedown pin hole and a pivot pin hole in an AR configuration, which are mounted to corresponding pin holes in the AR pattern lower receiver.

In some embodiments, a bolt can be configured for being included in a muzzle loader upper receiver, wherein the muzzle loader upper receiver is configured to be coupled to a AR pattern lower receiver assembly. The bolt can include a longitudinal axis and a longitudinal sequence comprising: a bolt tip; a cylindrical region; and a bolt end having a firing pin recess. In some aspects, the cylindrical region includes a cylindrical surface without any recesses. In some aspects, the cylindrical region is devoid of recesses or elevations between the front end and opener portion. In some aspects, an annular lip at the bolt tip includes an extractor in an extractor slot formed in the annular lip. In some aspects, a firing pin recess is included in the bolt and optionally a firing pin therein.

In some embodiments, a bolt can be configured for being included in an AR pattern muzzle loader upper receiver of an AR pattern muzzle loader upper receiver assembly, wherein the muzzle loader upper receiver assembly is configured to be coupled to a standard AR pattern lower receiver assembly. The bolt can include a unitary body having in a longitudinal axis and a longitudinal sequence that includes the following: a front end adapted to receive a charge; a cylindrical region with a uniform dimension optionally with a hammer pushing surface, where the cylindrical region can extend from the front end to an end slot or to a second end (e.g., back end or bolt tail) or to a planar surface formed into the cylinder surface in a portion of the circumference; optionally an end ramp across the end slot from the cylinder or planed surface, the end ramp extending upward; an end ridge extending from a top of the end ramp to the bolt tail (e.g., back end); if no end ramp, then the bolt may omit the end slot and the end ramp features; and a firing pin recess in the bolt end, wherein the firing pin recess optionally includes an opening from the bolt end around the end ramp and end ridge so as to be open with the end slot or it omits the opening and the bolt is cylindrical from the front end to the back end with or without the planed surface. In some aspects, the unitary body can have a first body portion of the bolt body extending from the bolt neck and terminating at a reduced dimension region (e.g., planar surface), and can have a second body portion extending from the reduced dimension region to the bolt end (e.g., a longitudinal portion with the planed surface in the cylinder). In some aspects, the cylindrical region includes a cylindrical surface, which includes a portion thereof that functions as the hammer pushing surface.

In some embodiments, a muzzle loader kit can include: a muzzle loader AR pattern upper receiver configured to be coupled with an AR pattern lower receiver, wherein the AR pattern lower receiver includes a trigger, the muzzle loader AR pattern upper receiver including a body with a barrel opening; and a muzzle loader barrel configured to be coupled to the barrel opening of the muzzle loader AR pattern upper receiver. In some aspects, the kit can include a muzzle loader bolt configured to slidably fit into the muzzle loader AR pattern upper receiver. In some aspects, the kit can include at least one of: a plurality of primer caps; a plurality of projectiles; charge for the muzzle loader AR rifle; or a ramrod for the muzzle loader.

One skilled in the art will appreciate that, for this and other processes and methods disclosed herein, the functions performed in the processes and methods may be implemented in differing order. Furthermore, the outlined steps and operations are only provided as examples, and some of the steps and operations may be optional, combined into fewer steps and operations, or expanded into additional steps and operations without detracting from the essence of the disclosed embodiments.

The present disclosure is not to be limited in terms of the particular embodiments described in this application, which are intended as illustrations of various aspects. Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is also to be understood that the terminology used herein is for the purpose of describing particular embodiments only, and is not intended to be limiting.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," and the like include the number recited and refer to ranges which can be subsequently broken down into subranges as discussed above. Finally, as will be understood by one skilled in the art, a range includes each individual member. Thus, for example, a group having 1-3 cells refers to groups having 1, 2, or 3 cells. Similarly, a group having 1-5 cells refers to groups having 1, 2, 3, 4, or 5 cells, and so forth.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

This patent application cross-references: U.S. application Ser. No. 16/818,960 filed Mar. 13, 2020; U.S. application Ser. No. 15/666,230 filed Aug. 1, 2017; and U.S. Provisional Application No. 62/373,499 filed Aug. 11, 2016, which applications are incorporated herein by specific reference in their entirety.

The invention claimed is:

1. A muzzle loader AR upper receiver comprising:

a muzzle loader AR upper receiver configured to be coupled with an AR lower receiver, the muzzle loader AR upper receiver including a body with a barrel opening, the body having a bolt opening with a handle slot extending therefrom through the body with a bolt rest slot extending from the handle slot;

a muzzle loader bolt in the bolt opening in the muzzle loader AR upper receiver, wherein the muzzle loader bolt is mostly cylindrical from a breach plug end to a proximal end, wherein the muzzle loader bolt is rotatable and longitudinally slidable within the bolt opening;

a bolt handle protruding laterally from the muzzle loader bolt and extending through the handle slot in the AR upper receiver, wherein actuation of the bolt handle between the handle slot to the bolt rest slot rotates the muzzle loader bolt in the bolt opening; and a muzzle loader barrel coupled to the barrel opening of the muzzle loader AR pattern upper receiver.

2. The muzzle loader AR upper receiver of claim 1, wherein the muzzle loader AR upper receiver includes a takedown pin hole and a pivot pin hole in an AR configuration.

3. The muzzle loader AR upper receiver of claim 1, comprising a ramrod coupled to the muzzle loader upper receiver.

4. The muzzle loader AR upper receiver of claim 1, wherein the muzzle loader barrel includes a breach plug opposite of a muzzle barrel open end.

5. The muzzle loader AR upper receiver of claim 1, wherein the muzzle loader barrel includes a protruding annular ridge on an external surface thereof proximal to the breach plug end with a region between the annular ridge and breach plug end surface.

6. The muzzle loader AR upper receiver of claim 5, wherein the annular ridge on the barrel receives a barrel coupling nut that couples the muzzle loader barrel with the muzzle loader AR pattern upper receiver.

7. The muzzle loader AR upper receiver of claim 4, wherein the breach plug has a charge side facing the muzzle barrel open end and a primer side facing away from the muzzle barrel open end, wherein the breach plug includes a primer cap slot for holding a primer cap, and the breach plug includes a conduit from the primer cap side to the charge side.

8. The muzzle loader AR upper receiver of claim 4, wherein the breach plug omits the primer cap slot, and the bolt includes a primer cap slot.

9. A muzzle loader AR rifle, comprising:

the muzzle loader AR upper receiver of claim 1; and the AR pattern lower receiver coupled to the muzzle loader AR upper receiver.

10. The muzzle loader AR rifle of claim 9, wherein the muzzle loader AR upper receiver includes a takedown pin hole and a pivot pin hole in an AR configuration.

11. The muzzle loader AR rifle of claim 9, comprising a ramrod coupled to the muzzle loader upper receiver.

12. The muzzle loader AR rifle of claim 9, wherein the muzzle loader barrel includes a breach plug opposite of a muzzle barrel open end.

13. The muzzle loader AR rifle of claim 9, wherein the muzzle loader barrel includes a protruding annular ridge on an external surface thereof proximal to the breach plug end with a region between the annular ridge and breach plug end surface, wherein the annular ridge on the barrel receives a barrel coupling nut that couples the muzzle loader barrel with the muzzle loader AR upper receiver.

14. The muzzle loader AR rifle of claim 12, wherein the breach plug has a charge side facing the muzzle barrel open end and a primer side facing away from the muzzle barrel open end, wherein the breach plug includes a primer cap slot for holding a primer cap, and the breach plug includes a conduit from the primer cap side to the charge side.

15. The muzzle loader AR rifle of claim 12, wherein the breach plug omits the primer cap slot, and the bolt includes a primer cap slot.

16. A method of forming a muzzle loader rifle, comprising:

providing the muzzle loader AR upper receiver of claim 1; and coupling the muzzle loader AR upper receiver to an AR lower receiver.

17. The method of claim 16, further comprising coupling a muzzle loader barrel to a barrel opening of the muzzle loader AR upper receiver.

18. The method of claim 16, wherein the muzzle loader AR upper receiver is provided with a muzzle loader barrel coupled to a barrel opening of the muzzle loader AR upper receiver.

19. The method of claim 16, wherein a bolt is in the muzzle loader AR upper receiver.

20. The method of claim 16, wherein the muzzle loader AR upper receiver includes a takedown pin hole and a pivot pin hole in an AR configuration, which are mounted to corresponding pin holes in the AR lower receiver.

21. A bolt configured for being included in a muzzle loader upper receiver, wherein the muzzle loader upper receiver is configured to be coupled to a AR lower receiver assembly, the bolt comprising a longitudinal axis and a longitudinal sequence comprising:

a bolt tip;

a recess in the bolt tip to form an annular lip, with a slot extending laterally from the recess through the annular lip;

a cylindrical region;

a bolt handle protruding laterally from the cylindrical region, and a bolt end having a firing pin recess.

22. The bolt of claim 21, wherein the cylindrical region includes a cylindrical surface without any dimension-changing recesses.

23. The bolt of claim 21, wherein the cylindrical region is devoid of dimension changing recesses or elevations between the bolt tip and bolt end.

24. The bolt of claim 21, comprising an extractor in the slot formed in the annular lip.

25. The bolt of claim 21, comprising a firing pin recess and optionally including a firing pin therein.

26. A muzzle loader kit comprising:

a muzzle loader AR upper receiver configured to be coupled with an AR lower receiver, the muzzle loader AR upper receiver including a body with a barrel opening, the body having a bolt opening with a handle slot extending therefrom through the body with a bolt rest slot extending from the handle slot;

a muzzle loader bolt configured to be operably located in the bolt opening in the muzzle loader AR upper receiver, wherein the muzzle loader bolt is mostly cylindrical from a breach plug end to a proximal end, wherein the muzzle loader bolt is rotatable and longitudinally slidable within the bolt opening, wherein a bolt handle protrudes laterally from the muzzle loader bolt and is configured to extend through the handle slot in the AR upper receiver, wherein actuation of the bolt handle between the handle slot to the bolt rest slot rotates the muzzle loader bolt in the bolt opening; and a muzzle loader barrel configured to be coupled to the barrel opening of the muzzle loader AR upper receiver.

27. The muzzle loader kit of claim 26, further comprising a muzzle loader bolt configured to slidably fit into the muzzle loader AR upper receiver.

28. A kit of claim 26, further comprising at least one of:

a plurality of primer caps;

a plurality of projectiles;

charge for the muzzle loader AR rifle; or a ramrod.

29. The bolt of claim 21, wherein the bolt handle protrudes from a bolt handle recess that is adjacent to the bolt end.

30. The bolt of claim 21, wherein the cylindrical region extends from the bolt tip to the bolt end.

31. The bolt of claim 21, wherein the cylindrical region is devoid of elevation changes or narrowing regions.

32. The muzzle loader AR upper receiver of claim 1, wherein the bolt handle protrudes from a bolt handle recess that is adjacent to the bolt end, and the cylindrical region extends from the bolt tip to the bolt end without elevation changes or narrowing regions.

* * * * *